US008632070B2

(12) United States Patent
Nonaka

(10) Patent No.: US 8,632,070 B2
(45) Date of Patent: Jan. 21, 2014

(54) IMAGE FORMING APPARATUS, METHOD FOR CONTROLLING IMAGE FORMING APPARATUS, AND RECORDING MEDIUM

(75) Inventor: Takashi Nonaka, Kunitachi (JP)

(73) Assignee: Canon Kabushiki Kaisha, Tokyo (JP)

( * ) Notice: Subject to any disclaimer, the term of this patent is extended or adjusted under 35 U.S.C. 154(b) by 173 days.

(21) Appl. No.: 13/213,977

(22) Filed: Aug. 19, 2011

(65) Prior Publication Data

US 2012/0049434 A1 Mar. 1, 2012

(30) Foreign Application Priority Data

Aug. 25, 2010 (JP) ..... 2010-187832

(51) Int. Cl.
*B65H 7/02* (2006.01)

(52) U.S. Cl.
USPC ..... 271/265.01; 399/376; 399/389

(58) Field of Classification Search
USPC ..... 271/9.06, 265.01, 265.02; 399/370, 399/376, 389
See application file for complete search history.

(56) References Cited

U.S. PATENT DOCUMENTS 6,718,145 B2 * 4/2004 Ohta et al. ..... 399/16
2007/0071468 A1 * 3/2007 Yako ..... 399/45

FOREIGN PATENT DOCUMENTS

JP 2004-004622 A 1/2004
JP 2005-283874 A 10/2005

* cited by examiner

*Primary Examiner* — Michael McCullough
(74) *Attorney, Agent, or Firm* — Canon USA, Inc., IP Division

(57) ABSTRACT

An image forming apparatus for performing image formation on a fed sheet includes a feeding unit, a detecting unit, a conveying control unit, and a first, second, and third determining unit. The feeding unit feeds a sheet of an irregular size onto a conveyance path. The detecting unit detects timings at which a leading edge and trailing edge of the fed sheet pass through a conveyance path predetermined position. The first determining unit determines a length of the sheet in a width direction. The conveying control unit discharges the sheet to a discharge destination without performing image formation on the sheet. The second determining unit determines a length of the sheet in the conveyance direction. The third determining unit determines a sheet size of the sheet of the irregular size from the length of the sheet in the width direction and the length of the sheet in the conveyance direction.

6 Claims, 25 Drawing Sheets

IN APPARATUS, SEQUENCE IN THE CASE WHERE TRAILING EDGE DETECTION CAN BE PERFORMED IN THE STATE SHEET STANDBY POSITION CAN BE ENSURED BEFORE PRINTING

IN APPARATUS, SEQUENCE IN THE CASE WHERE TRAILING EDGE DETECTION CANNOT BE PERFORMED IN THE STATE SHEET STANDBY POSITION CAN BE ENSURED BEFORE PRINTING

IMAGE FORMING APPARATUS, METHOD FOR CONTROLLING IMAGE FORMING APPARATUS, AND RECORDING MEDIUM

BACKGROUND OF THE INVENTION

1. Field of the Invention

The present invention relates to an image forming apparatus, a method for controlling the image forming apparatus, and a recording medium.

2. Description of the Related Art

In the market, image forming apparatuses capable of forming an image using a sheet of a size other than a regular-size sheet of the A series or the B series according to the Japanese Industrial Standards (JIS), or the inch series in European and American standards have been put to practical use.

As settings and systems for using such sheets of irregular sizes (free size or user-set size), the following systems have been proposed. The sheet sizes of irregular sizes are much in demand not only in general users of consumers but in the printing industry.

Examples of known setting methods and detection methods of an irregular sheet size include the following methods. A first method is a setting method called a free size. The sheet size includes a length (hereinafter, referred to as X size) in a sheet conveyance direction and a length (hereinafter, referred to as Y size) in a sheet width direction.

In the free size, in response to user's setting operation of a sheet on a manual feed tray of an image forming apparatus, a screen for setting a sheet size is displayed on an operation panel. Then, if the user selects the free size, the sheet size of the free size can be set (see 701 in FIG. 6).

When such setting is performed, the X size and the Y size are indefinite. Then, at the image forming apparatus side, processing for automatically detecting the size is performed. In such a case, the image forming apparatus detects the set X size by conveying the sheet and by using a sensor for detecting the leading edge or the trailing edge of the sheet in the conveyance path.

On the other hand, the Y size is detected using a guide that is fit when the sheet is set on the manual tray. In the method, the user's setting operation is not so complicated. However, there is a problem that the accurate size of the X size is not determined until the sheet is conveyed.

Meanwhile, in a configuration where formation of an image on a transfer member is started before conveyance of a sheet is started in an image forming apparatus, the image formation has to be performed before the sheet size is determined.

In such a case, by the above-mentioned method, at the time the sheet size is determined, the image formation of the size larger than the sheet size has already been performed. Accordingly, it is necessary to collect and clean the toner of the image that has not been transferred from the transfer member to the sheet. Otherwise, inside of the image forming apparatus may become dirty.

A second method is a setting method called a user-set size. In the method, similarly to the free size, in response to user's setting operation of a sheet on a manual feed tray of an image forming apparatus, a screen for setting a sheet size is displayed on an operation panel. Then, the user sets a user-set size on the panel.

In the setting, by inputting the X size and the Y size in millimeters or inches by the user, the problem in the free size that the sheet size is not determined before the image formation start can be avoided. Accordingly, the method can also be applied to a configuration in which the image formation is started before the conveyance of the sheet is started in the image forming apparatus.

However, in this setting, the user is required to correctly set the X size and the Y size to the image forming apparatus, and this may complicate the setting operation of the user. Further, the user may mistakenly reversely set the vertical direction and the width direction of the actual sheet size.

In Japanese Patent Application Laid-Open No. 2004-004622, in a monochromatic mode, an apparatus is operated in the free size, and in a color mode, the apparatus is operated in the user-set size that requires input of an X size and a Y size. By this technique, the known art for reducing the complication in the user's setting operation has been proposed.

Meanwhile, Japanese Patent Application Laid-Open No. 2005-283874 has proposed a known art for reducing the complication in the user's setting operation by detecting the size of a sheet of an irregular size by reading with a document positioning plate of a document reading device included in an image forming apparatus and reflecting the detected size to a manual feed sheet size.

However, in Japanese Patent Application Laid-Open No. 2004-004622, apart of the settings is omitted depending on the color mode, and accordingly, the problem in the complication in the user's setting operation is not solved. In the case of Japanese Patent Application Laid-Open No. 2005-283874, it is assumed that the original size is the same as the manual size. Accordingly, the user is required to once set the sheet on the document positioning plate, perform the reading operation, and set the sheet to the manual feed tray again.

Further, to a configuration of a printer model that does not have the document reading unit, Japanese Patent Application Laid-Open No. 2005-283874 cannot be effectively applied. Thus, according to the techniques of Japanese Patent Application Laid-Open No. 2004-004622 and Japanese Patent Application Laid-Open No. 2005-283874, in an image forming apparatus that can perform feeding of a sheet material and image formation to the sheet material in parallel, a sheet of an irregular size cannot be determined without user's burden in the operation.

SUMMARY OF THE INVENTION

According to an aspect of the present invention, an image forming apparatus for performing image formation on a sheet includes a feeding unit configured to feed a sheet of an irregular size onto a conveyance path, a detecting unit configured to detect timings at which a leading edge and at which a trailing edge of the sheet of the irregular size pass through a predetermined position on the conveyance path, a first determining unit configured to determine a length of the sheet in a width direction fed from the feeding unit, a conveying control unit configured to discharge the sheet fed from the feeding unit to a discharge destination using the conveyance path without performing image formation on the sheet by an image forming unit, a second determining unit configured to determine a length of the sheet in the conveyance direction by detecting the sheet conveyed on the conveyance path by the conveying control unit using the detecting unit, and a third determining unit configured to determine a sheet size of the sheet of the irregular size from the length of the sheet in the width direction determined by the first determining unit, and the length of the sheet in the conveyance direction determined by the second determining unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1A:
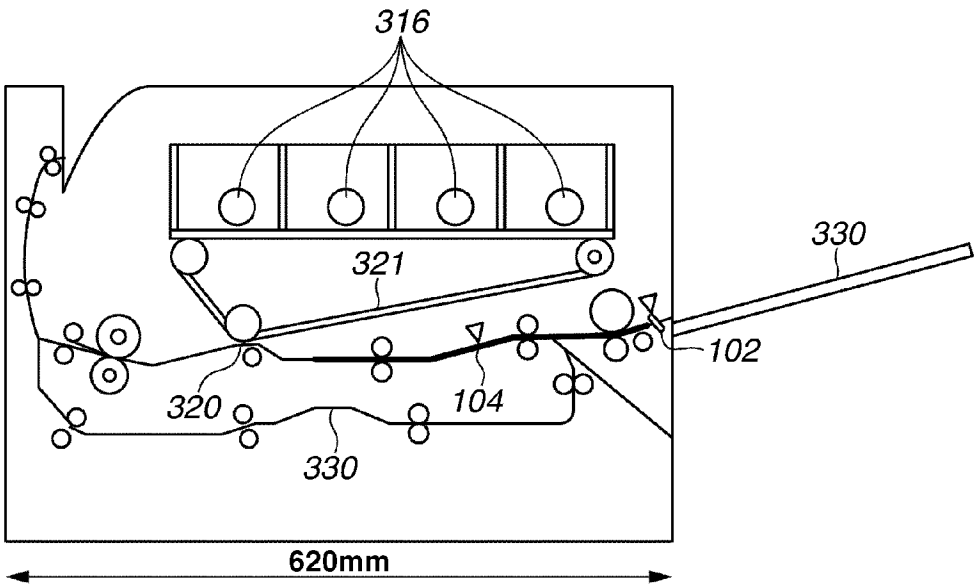
FIGS. 1A and 1B illustrate a configuration of an image forming apparatus.
Figure 1B:
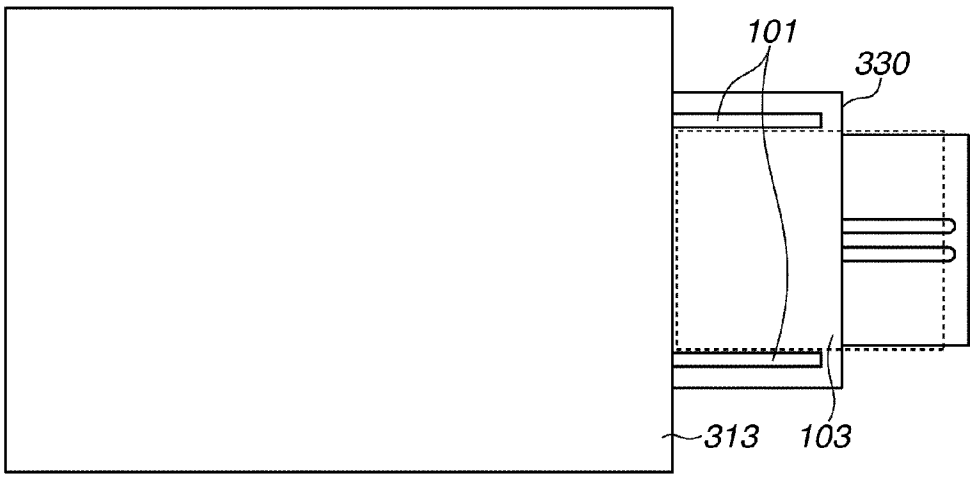

FIGS. 1A and 1B illustrate a configuration of an image forming apparatus according to a first exemplary embodiment. FIG. 1A is a cross-sectional view of the image forming apparatus, and FIG. 1B is a plan view of the image forming apparatus viewed from the top.

The image forming apparatus according to the present exemplary embodiment includes a manual feed tray that serves as manual feed unit. The image forming apparatus is configured to be able to feed a sheet material (hereinafter, referred to as paper or sheet) of a regular size or an irregular size to be placed on the manual feed tray. An irregular sheet size includes free size, a user-set size, and sheet sizes that may be used less than half the time in a given image forming apparatus over a life of the given image forming apparatus.

In the present exemplary embodiment, an example of an image forming apparatus that has an image forming unit capable of forming a color image in a four-drum system, and forming the color image by transferring a color image transferred to an intermediate transfer belt 321 on a conveyed sheet is described.

In FIGS. 1A and 1B, paper guide plates 101 are a part of a manual feed tray 330. The paper guide plates 101 are configured in such a manner that, for example, after setting a sheet 103 of an irregular size on the manual feed tray 330, the user can slide the paper guide plates 101 to fit them to the sheet width.

In response to the regulation of the irregular size from both sides by sliding the sheet guide palates 101, from a sensor for detecting positions of the sheet guide palates, information for determining a length of the sheet in the width direction is input to a central processing unit (CPU) 402 that is described below. The CPU 402 controls image formation of the image forming unit, conveyance of sheets, or the like by executing programs according to procedures of flowcharts described below.

Thus, the CPU 402 serves as a first determining unit that determines the length of the irregular-size sheet in the width direction set on the manual feed tray 330 by acquiring the information of the slide positions. Processing for determining a length in a conveyance direction performed by the CPU 402 that serves as a second determining unit is described below.

In the present exemplary embodiment, the paper guide plates 101 are connected to an electric sensor. By sliding the paper guide plates 101, an A/D value is notified to the CPU 402 of a main controller 401 described below. Then, the CPU 402 can determine a sheet width.

The sheet set on the manual feed tray 330 is started to be conveyed at a predetermined speed, the leading edge of the sheet passes through a detection sensor (hereinafter, simply referred to as sensor) 102 provided at a predetermined position on the conveyance path, and the sheet is conveyed to a position 104.

The sensor 102 is turned on at the time the conveyance of the sheet is started from a holding position on the manual feed tray 330 illustrated in FIG. 1B and the leading edge of the sheet passes through the sensor 102. The sensor 102 is turned off after the sheet is conveyed at the predetermined speed and at the time the trailing edge of the sheet passes through the sensor 102. The sensor 102 serves as a sensor for detecting a leading edge and a trailing edge of a conveyed sheet.

In the present exemplary embodiment, the CPU 402 can determine the length of the sheet in the conveyance direction using the speed information of the conveyed sheet and the timer elapsed time from the time the sensor 102 is turned on to the time the sensor is turned off. The CPU 402 serves as first to third determining units, and determines the length in the width direction, the length in the conveyance direction, and the sheet size as described below.

In the case of the sheet size illustrated in FIG. 1B, in a state that the leading edge of the sheet does not arrive at a position 320 that is a secondary transfer position of the image, the trailing edge of the sheet has passed through the sensor 102. Accordingly, the sheet can also be used as (a first sheet of) a sheet for normal printing without conveying a special sheet for the purpose of sheet size detection. The image forming apparatus of such use is described in detail in a second exemplary embodiment.

FIGS. 1A and 1B illustrate a general image forming apparatus of an office model. The width of the image forming apparatus is, for example, about 620 mm. A maximum sheet size used in the case where the trailing edge of the sheet passes through the sensor 102 while the leading edge of the sheet does not arrive at the position 320 is 297 mm or an equivalent size. The size of 297 mm corresponds to A4 short edge feed.

If the sheet size is larger than the above-described size, before the trailing edge of the sheet passes through the sensor 102, the leading edge of the sheet arrives at the position 320. Then, it is not possible to use the sheet for the sheet size detection also as the sheet for the normal printing. If an image is formed on such a sheet, before feeding the sheet for image formation, the image forming apparatus detects the sheet size by feeding a special sheet for the sheet size detection having the same size as the sheet for the image formation.

Figure 2:
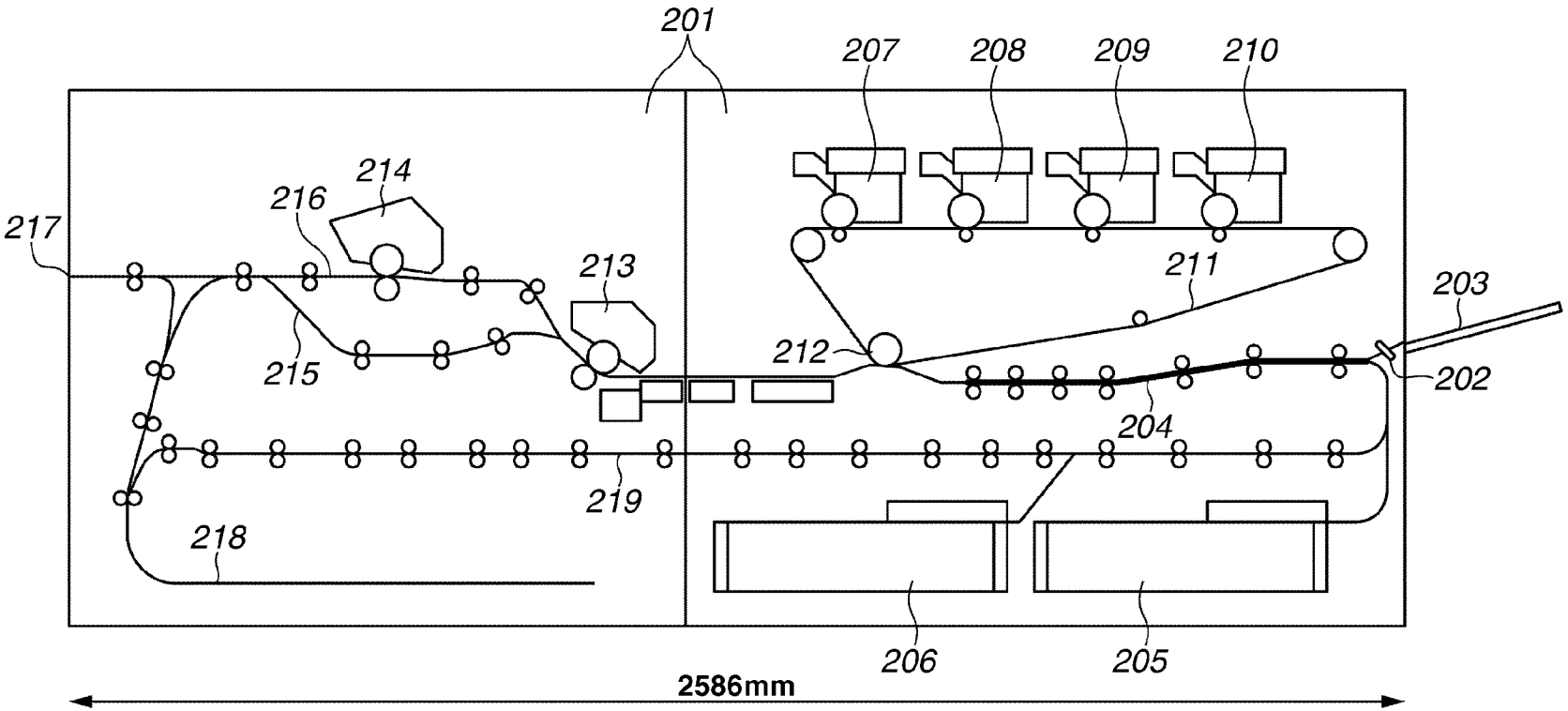
FIG. 2 illustrates a configuration of an image forming apparatus.

FIG. 2 is an example of a sheet conveyance path of an image forming apparatus. The body is an example of an image forming apparatus of a POD model. The image forming apparatus described in the present exemplary embodiment is a large apparatus having a width size of 2500 mm or more.

In FIG. 2, the right part of an image forming apparatus 201 is an image forming apparatus body, and the left part is an image fixing apparatus. Similar to the office model in FIG. 1, in the vicinity of a sheet feed port, a sensor 202 for detecting the trailing edge of the sheet is disposed.

From a manual tray 203, a sheet is fed. After the sheet is conveyed and before the sheet arrives at a position (indicated by the bold solid line) on the conveyance path illustrated in FIG. 2, the sensor 202 detects the trailing edge, and determines the sheet length. Paper feed decks 205 and 206 operate as sheet feeding units other than a manual feed unit.

Developing units 207 to 210 include four stations of Y, M, C, and K for forming a color image. The images formed by the units are primary transferred onto an intermediate transfer belt 211, then, the intermediate transfer belt 211 rotates in the clockwise direction in FIG. 2, and the images are transferred to sheet 204 at a position 212 that is a secondary transfer position.

The images transferred to the sheet are heated and pressed by a fixing device 213, and fixed to the sheet. The sheet having passed through the fixing device 213 passes through a conveyance path 215. Then, the sheet is output to the outside 217 of the apparatus.

Depending on the type of the sheet, additional heating and pressing for fixation may be required. In such a case, after the sheet having passed through the fixing device 213, the sheet is conveyed to a second fixing device 214 using an upper conveyance path, and the additional heating and pressing is performed. Then, the sheet passes through a conveyance path 216, and is output to the outside 217 of the apparatus.

If the image formation mode is set to a two-sided printing mode, the sheet is conveyed to a sheet reversing path 218, and reversed on the sheet reversing path 218. Then, the sheet is conveyed to a two-sided printing conveyance path 219, refeeding of the sheet is performed, and image formation onto a second side of the two sides is performed again at the position 212.

As illustrated in FIG. 2, in the case of the image forming apparatus of the POD model, the conveyance paths of the sheet are long. Thus, as compared to the office model, the range that the sheet length can be detected at a position corresponding to the sheet 204 is wide. As a result, a maximum sheet size enabling the trailing edge of the sheet to pass through the sensor 202 while the leading edge of the sheet does not arrive at the position 212 is the 13×19 inch size (487.8 mm) or an equivalent size.

Accordingly, in the case of the POD model, except for special sizes (long size: up to 630 mm), nearly all sheets for sheet size detection can also be used for the normal printing.

Figure 3:
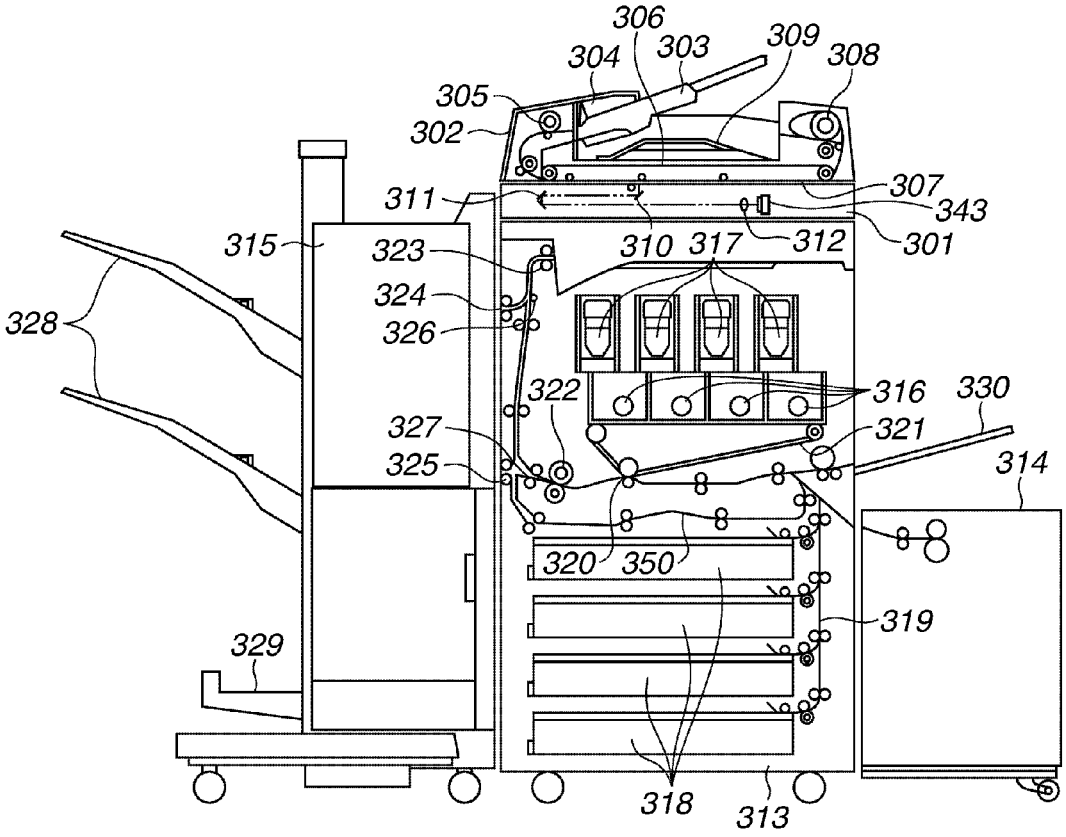
FIG. 3 illustrates a configuration of an image forming apparatus.

FIG. 3 is a cross-sectional view illustrating a configuration of an image forming apparatus according to the present exemplary embodiment. The exemplary embodiment is an example of a multifunction peripheral (MFP) having functions of a copying machine, a printer, and a facsimile.

In the present exemplary embodiment, an example of an image forming apparatus capable of discharging supplied sheets to a plurality of discharging units is described. Accordingly, as in the example, for the case the plurality of discharging units are provided, if a sheet, for example, a sheet of an irregular size is fed from a manual feed tray, a destination to which a first sheet is to be discharged can be switched to any unit.

In FIG. 3, the MFP includes a scanner 301, a document feeder (DF) 302, a printer 313 for print recording having four-color drums, a sheet feed deck 314, and a finisher 315.

First, reading operation mainly performed by the scanner 301 is described. In a case where the reading is performed after a document is set on a document positioning plate, the document is set on a document positioning plate 307, and the DF 302 is closed. Then, an open-close sensor detects that the document positioning plate is closed, and a reflective type document size detection sensor provided in the case of the scanner 301 detects the size of the set document.

In response to the size detection, the document is irradiated with a light source 310, and an image is read by a charge coupled device (CCD) 343 via a light reflector 311 and a lens 312. Then, the image is converted into a digital signal, intended image processing is performed, and converted into a laser recording signal. The converted recording signal is stored in a memory in a controller which is described below with reference to FIG. 4.

If the document is set on the DF 302 and the reading is performed, the document is placed on a tray of a document set unit 303 of the DF 302 in a face-up state. Then, a document presence sensor 304 detects that the document has been set. In response to the detection, a sheet feed roller 305 and a conveyance belt 306 rotate to convey the document, and the document is set to a predetermined position on the document positioning plate 307. In the following processing, the image is read similarly to the reading on the document positioning plate, and stored in the memory in the controller.

After the completion of the reading, the conveyance belt 306 rotates again to convey the document to the right side in the drawing, and discharges the document on a document discharge tray 309 via a conveyance roller 308 of the sheet discharge side.

If a plurality of documents exist, simultaneously with the conveyance and discharge of the document from the document positioning plate to the right side in FIG. 3, a next document is fed from the left side via the sheet feed roller 305, and reading of the next document is sequentially performed. The above-described processing is the operation of the scanner.

Figure 4:
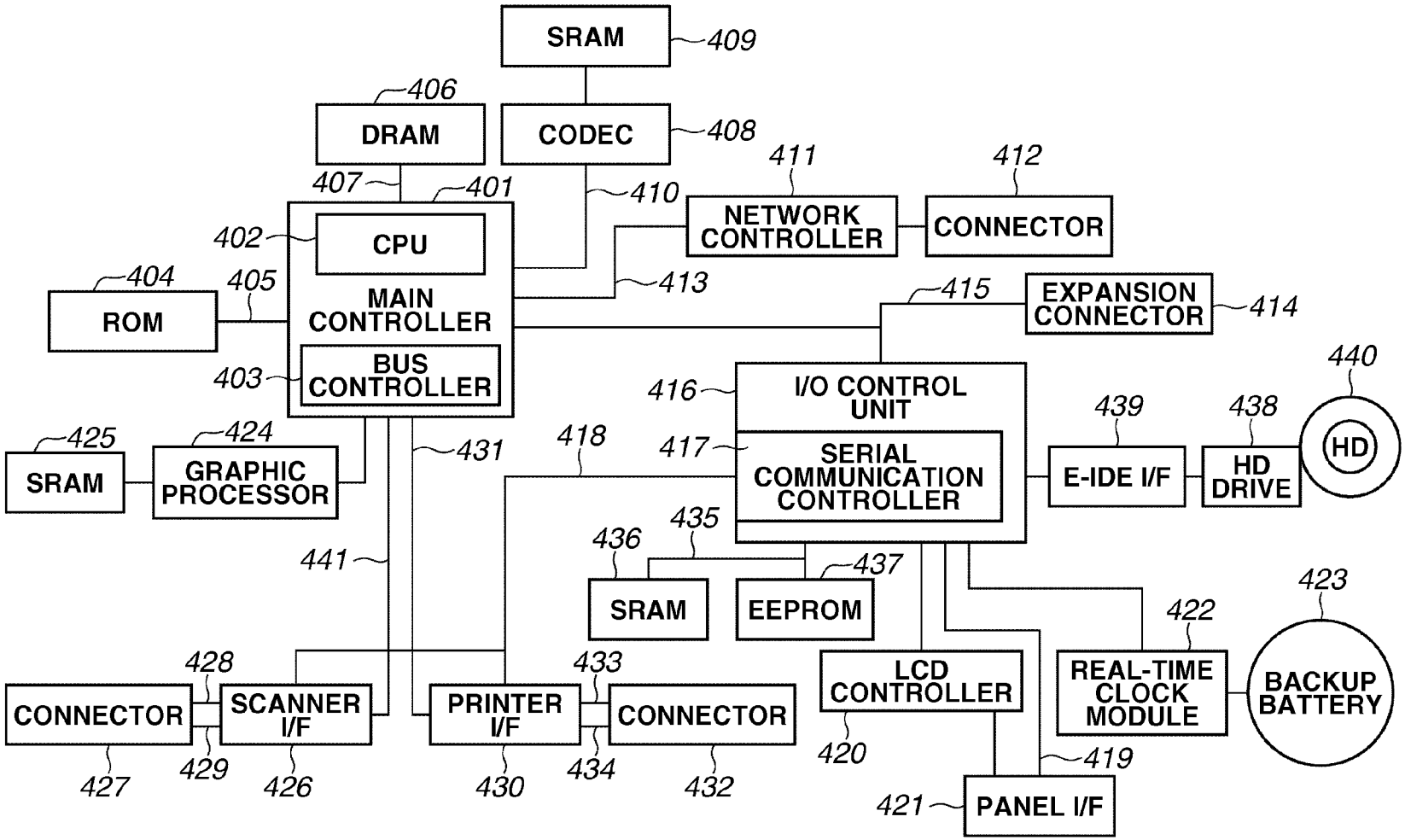
FIG. 4 is a block diagram illustrating a control configuration of an image forming apparatus.

Next, printing operation mainly performed by the printer 313 is described. A recording signal (print image data) temporarily stored in the memory in the controller to be described with reference to FIG. 4 is transferred to the printer 313, and converted into recording laser beams of four colors of yellow, magenta, cyan, and black in a laser recording unit.

Then, a photosensitive member 316 of each color are irradiated with the recording laser beam, and electrostatic latent images are formed on the individual photosensitive members respectively. Then, toner development is performed using toner supplied from a toner cartridge 317, and primary transfer of the visualized images onto the intermediate transfer belt 321 is performed.

The intermediate transfer belt 321 rotates in the clockwise direction. At the time when the recording sheet supplied from a sheet cassette 318 or a sheet feed deck 314 via a sheet feed and conveyance path 319 arrives at a position 320 to be a secondary transfer position, the images are transferred from the intermediate transfer belt 321 onto the recording sheet.

On the recording sheet on which the image is transferred, the toner is fixed by pressure and heat by a fixing device 322. The recording sheet is conveyed on a sheet discharge conveyance path, and discharged to a face-down center tray 323, a discharge port 324 to a finisher by switching back, or a face-up side tray 325. The side tray 325 is a discharge port that can discharge a sheet only in a case where a finisher 315 is not mounted.

Flappers 326 and 327 are used to switch conveyance paths to switch the discharge ports. In two-sided printing, after the recording sheet passes through the fixing device 322, the flapper 327 switches the conveyance paths. Then, the recording sheet is switched back and conveyed downward, and further conveyed to the position 320 again via a conveyance path 350 for two-sided printing. By the processing, the two-sided printing is implemented.

The two-sided printing circulating control is performed within the conveyance path including the conveyance path 350 for two-sided printing, the position 320, and the fixing device 322. For sheets of the A4 size or the Letter (LTR) size, five-sheet circulating control is performed. For sheets larger than the A4 size or the LTR size, three-sheet circulating control is performed.

Next, operation performed in the finisher 315 is described. The finisher 315 performs post-processing on printed sheet according to a function specified by the user. Specifically, the finisher 315 has a stapler function (binding at a position or two positions), a punching function (two holes or three holes), a function of a saddle stitching binding, and the like.

The MFP illustrated in FIG. 3 includes two sheet discharge trays 328. A recording sheet that has passed through the sheet discharge port 324 to the finisher 315 is sorted to one of the sheet discharge trays according to the user's setting, for example, the copy function, the printing function, or the facsimile function.

If the apparatus is used as a printer, using a driver, various settings can be performed. The settings include settings in monochrome printing/color printing, a sheet size, 2UP printing, 4UP printing, or N-UP printing, two-sided printing, stapling, punching, saddle-stitching binding, an inserted sheet, a front cover, and a back cover.

A hardware configuration of the controller for performing control of a scanner unit, a printing unit, and a network interface unit of the image forming apparatus is described in detail with reference to FIG. 4. FIG. 4 is a block diagram illustrating a control configuration of an image forming apparatus according to the present exemplary embodiment.

In FIG. 4, the main controller 401 includes main components such as a CPU 402, a bus controller 403, and various I/F controller circuits.

The CPU 402 and the bus controller are used to control overall operation of the apparatus. The CPU 402 performs image formation control according to a program read from a read-only memory (ROM) 404 via a ROM I/F 405.

Figure 9A:
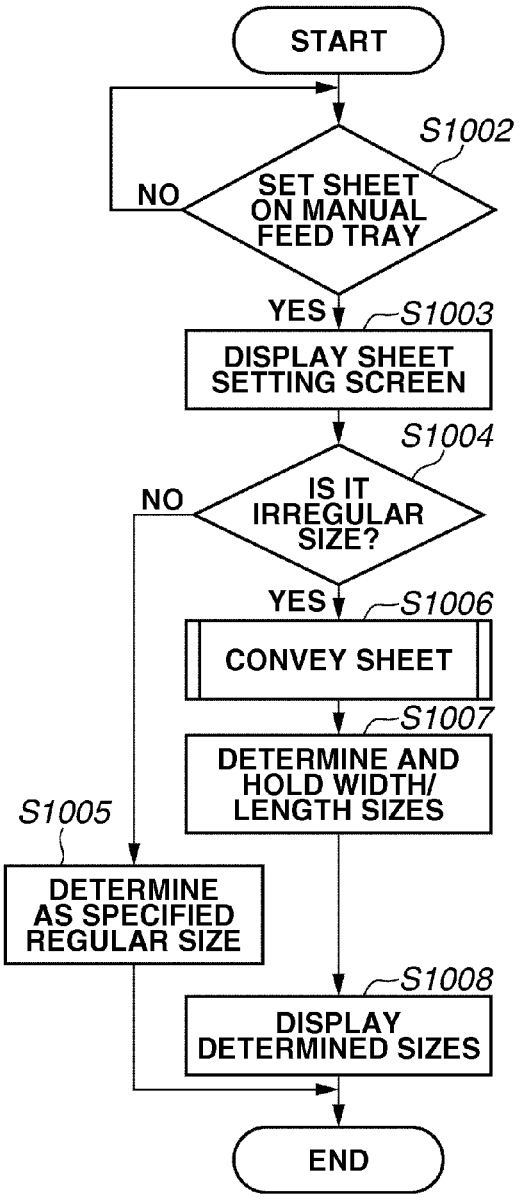
FIGS. 9A and 9B are flowcharts illustrating a control procedure of the image forming apparatus.
Figure 9B:
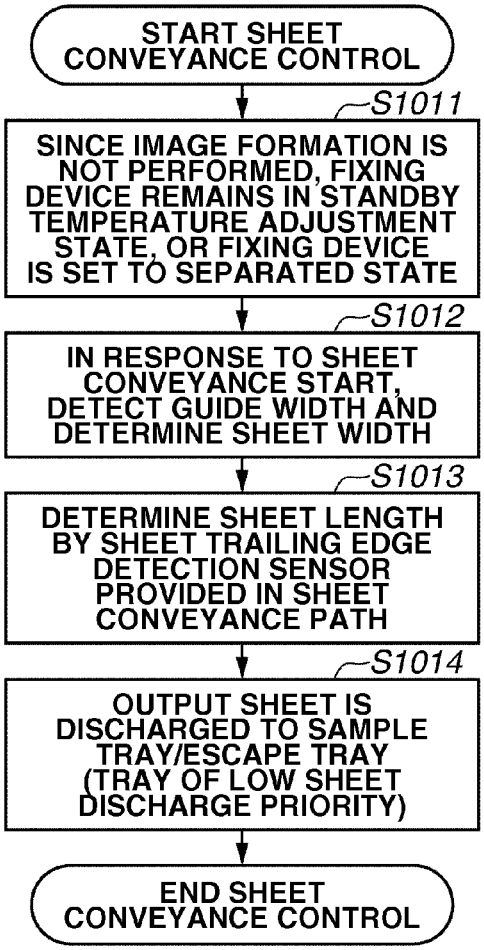

The CPU 402 determines a conveyance length of a manually supplied sheet using time for detecting the leading edge and the trailing edge of the sheet conveyed first to determine the size of the manually supplied sheet as illustrated in FIGS. 9A and 9B, and a sheet conveyance speed. In the processing, the CPU 402 performs different sequences illustrated in FIG. 10A or FIG. 10B depending on timing the sensor 102 detects the leading edge and the trailing edge of the sheet.

The program further includes a description of a process of interpreting Page Description Language (PDL) code data received from an external personal computer (PC) via a network, and rasterizing (forming an image) the code data into raster image data. The program is processed by software. The bus controller 403 controls transfer of data input from or output to each interface (I/F), and performs bus mediation and control of DMA data transfer.

A DRAM 406 is connected to the main controller 401 via a DRAM I/F 407. The DRAM 406 is used as a work area for operation of the CPU 402 and a region for storing image data.

A codec 408 compresses raster image data stored in the DRAM 406 in a modified huffman (MH) method, a modified READ (MR) method, a Modified Modified READ (MMR) method, a Joint Bi-level Image Experts Group (JBIG) method, a Joint Photographic Experts Group (JPEG) method or the like, and conversely, decompresses code data that is being compressed and stored to raster image data.

An SRAM 409 is used as a temporary work area of the codec 408. The codec 408 is connected to the main controller 401 via an I/F 410. Data transfer between the codec 408 and the DRAM 406 is performed as DMA transfer under control of the bus controller 403.

A graphic processor 424 performs processing of image rotation, image magnification, color-space conversion, and binarization on the raster image data stored in the DRAM 406 respectively.

A static RAM (SRAM) 425 is used as a temporary work area of the graphic processor 424. The graphic processor 424 is connected to the main controller 401 via an I/F. Data transfer between the graphic processor 424 and the DRAM 406 is performed as DMA transfer under control of the bus controller 403.

A network controller 411 is connected to the main controller 401 via an I/F 413, and connected to an external network via a connector 412. An example of the network generally includes Ethernet (registered trademark).

A universal high-speed bus 415 is connected to an expansion connector 414 for connecting an expansion board and an I/O control unit 416. An example of the universal high-speed bus 415 generally includes a Peripheral Component Interconnect (PCI) bus.

The I/O control unit 416 includes two channels of asynchronous serial communication controllers 417 used to transmit a control command to and receive a control command from CPUs of the scanner unit and the printer unit. The I/O control unit 416 is connected to a scanner I/F circuit 426 and a printer I/F circuit 430 via an I/O bus 418.

A panel I/F 421 is connected to an LCD controller 420. The panel I/F 421 includes an I/F used to perform display on a liquid crystal screen on an operation unit and a key-input I/F used to perform input using hard keys and keys of a touch panel.

Figure 5A:
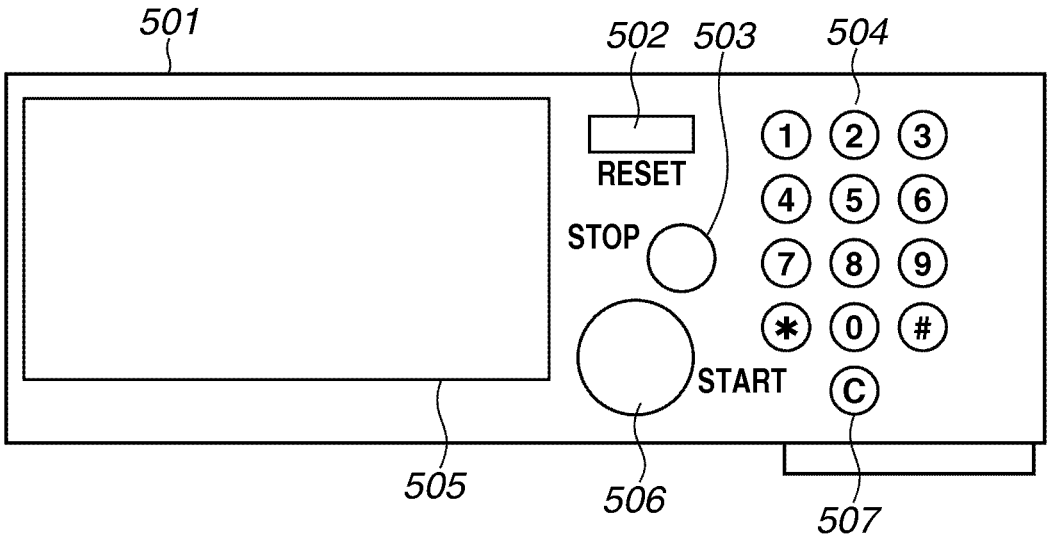
FIGS. 5A and 5B illustrate an operation unit of an image forming apparatus.

An operation unit 501 illustrated in FIG. 5A includes a liquid crystal display unit, a touch panel 505 attached on the liquid crystal display unit, and a plurality of hard keys. A signal input using the touch panel 505 or the hard keys is transmitted to the CPU 402 via the panel I/F 421. The liquid crystal display unit displays image data transmitted from the panel I/F 421.

The liquid crystal display unit displays a function screen in an operation of the image forming apparatus and various user interfaces (UIs) including image data, or the like.

A real-time clock module 422 updates and stores date and time to be managed in the apparatus. The real-time clock module 422 is backed up by a backup battery 423.

An E-IDE I/F 439 is used to connect an external storage device. In the present exemplary embodiment, through the I/F, a hard disk drive 438 is connected to store the image data in a hard disk 440, and reads the image data from the hard disk 440.

Connectors 427 and 432 are connected to the scanner unit and the printer unit respectively. The connectors 427 and 432 include asynchronous serial I/Fs 428, 433 and video I/Fs 429, 434.

A scanner I/F 426 is connected to the scanner unit via the connectors 427, and is connected to the main controller 401 via a scanner bus 441. The scanner I/F 426 has a function of performing predetermined processing on an image received from the scanner unit.

The scanner I/F 426 further has a function of outputting a control signal generated using a video control signal transmitted from the scanner unit to the scanner bus 441. Data transfer from the scanner bus 441 to the DRAM 406 is performed under control of the bus controller 403.

The printer I/F 430 is connected to the printer unit via the connector 432, and is connected to the main controller 401 via a printer bus 431. The printer I/F 430 has a function of performing predetermined processing on image data output from the main controller 401 and outputting the image data to the printer unit. The printer I/F 430 further has a function of outputting a control signal generated based on a video control signal transmitted from the printer unit to the printer bus 431.

Raster image data generated in the DRAM 406 is transferred to the printer unit as DMA transfer via the printer bus 431 and the video I/F 434 under control of the bus controller 403.

A SRAM 436 can maintain stored data, even if supply of electric power to the entire apparatus is blocked, by using electric power supplied from a backup battery. The SRAM 436 is connected to the I/O control unit via a bus 435. Similarly, an electrically erasable and programmable read only memory (EEPROM) 437 is connected to the I/O control unit via the bus 435. The hardware configuration of the controller has been described in detail above.

Next, a configuration of an operation unit for performing various types of print setting and user interfaces is described.

Figure 5B:
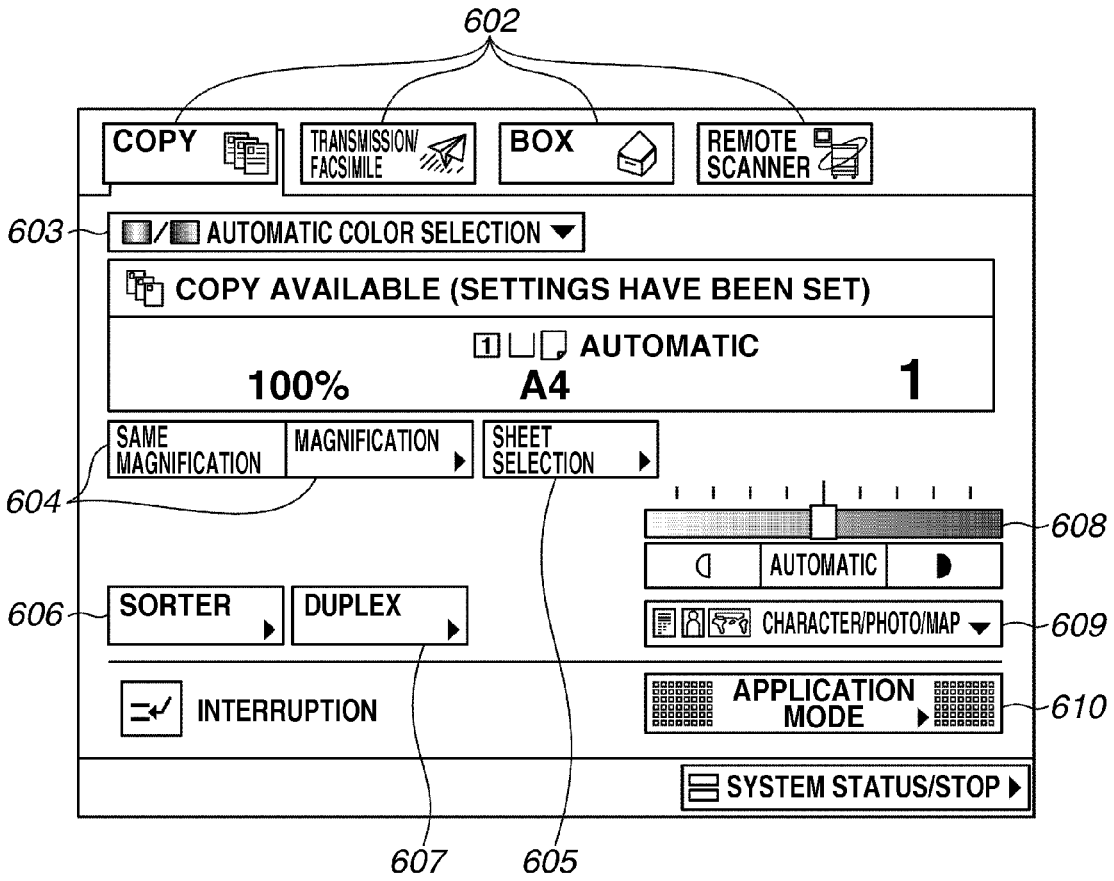

FIGS. 5A and 5B illustrate an operation unit of the image forming apparatus according to the present exemplary embodiment. FIG. 5A is a plan view of the entire operation unit. FIG. 5B illustrates an example of a UI displayed on a display screen illustrated in FIG. 5A.

In FIG. 5A, an operation unit 501 is connected to a tip of the panel I/F 421 illustrated in FIG. 4. A reset key 502 is used to cancel a set value set by the user, or the like. A stop key 503 is used to stop a job which is in operation. A numerical keypad 504 is used to input a numerical value such as an entry.

An operation screen 505 is a touch panel type, and specifically, the operation screen 505 displays a screen illustrated in FIG. 5B. The operation screen 505 includes many touch panel buttons for performing various settings. A start key 506 is used to start a job such as reading of an original document. A clear key 507 is used to clear a setting, or the like. Each of the parts in the operation unit has been described above.

The operation screen 505 is a touch panel, and contents to be displayed are described with reference to FIG. 5B. Tags 602 are used to select each function being displayed on an upper part of the screen. In FIG. 5B, from the left, the tags 602 includes a copy function, a transmission function such as facsimile transmission, e-mail transmission, and transmission to a file server, a box function, and a remote scanner function.

The box function includes functions of storing image data read by the scanner unit in a hard disk in the apparatus, and operating and printing the stored data. The remote scanner function includes a function capable of transferring a scanned image into a PC by operating from the PC via a network.

In response to operation of selecting the tag of each function by the user, the screen transfers to a screen on which individual detailed settings can be performed. The screen illustrated in FIG. 5B is an example of a screen to be displayed when the copy function is selected. A button 603 is used to select a color mode. By pressing the button 603, a pull-down menu is displayed, and a color mode can be selected from color, monochrome, and automatic modes. In FIG. 5B, "automatic" is being selected.

The touch panel 505 further includes a magnification specification button 604, a sheet selection button 605, a sorter button 606 for performing finishing specification such as shift sort and staple sort, and diplex button 607 for performing two-sided printing specification. The touch panel 505 further includes a bar 608 for specifying density, a button 609 for specifying a document type, and an application mode button 610 for setting other various application modes.

FIGS. 6A to 6F and 7A to 7D illustrate examples of the user interface displayed on the touch panel 505 illustrated in FIG. 5.

In FIGS. 6A to 6F, on a sheet size selection screen 701, a conventional free size can be selected. By selecting the button of free size, the screen is inverted in blue and to be in a selected state. Since input of an X size and a Y size is not necessary, the setting is not complicated (similar to setting of a regular size).

However, on a setting screen of application modes that can be selected by the application mode button 610 illustrated in FIG. 5B, as illustrated in an operation screen 1201 in FIGS. 7A to 7D, functions that cannot be selected are gray-out displayed.

Specifically, combinations of functions such as a moving function 1203, a bookbinding processing and an overhead projector (OHP) insertion function 1204, an image combining function 1205, a page printing/copy number printing function, and a stamp printing/date printing function are not permitted, and such combinations cannot be selected.

This is because these functions cannot be used to determine layout of an image, or the like unless a sheet size is not determined. Accordingly, although there is no complication in the setting of the free size, there are many restrictions in the combinations of the application modes.

Figure 6A:
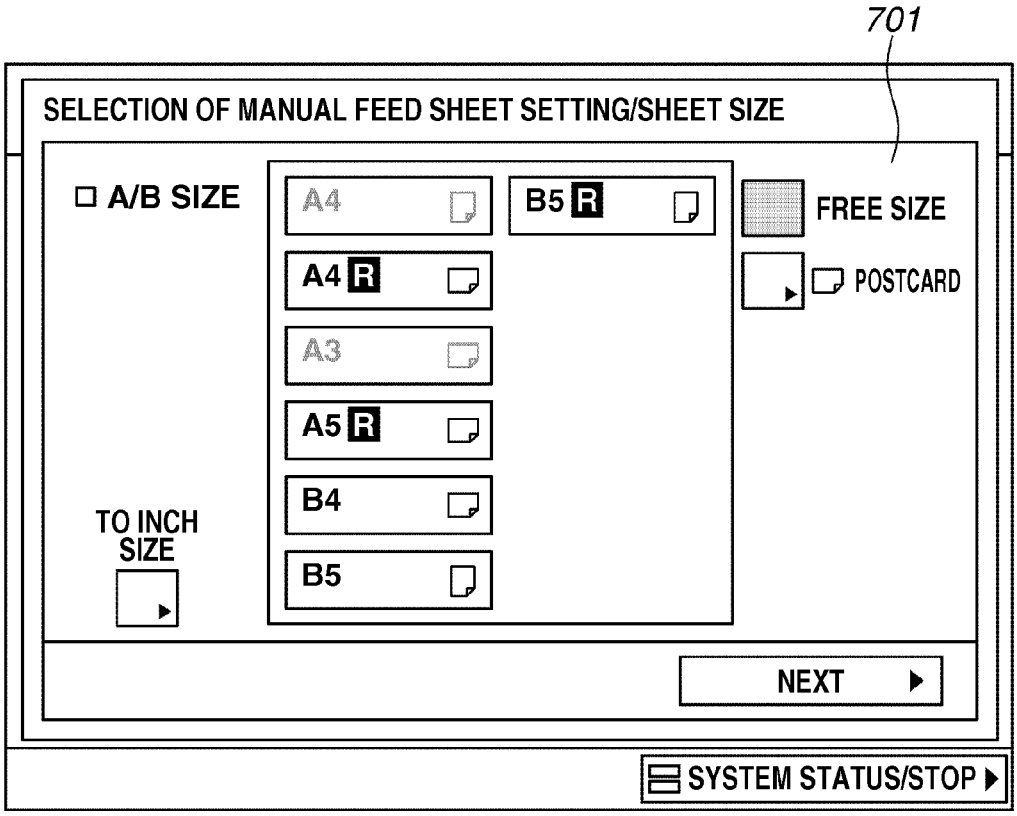
FIGS. 6A to 6F each illustrate a user interface (UI) displayed on a touch panel.
Figure 6B:
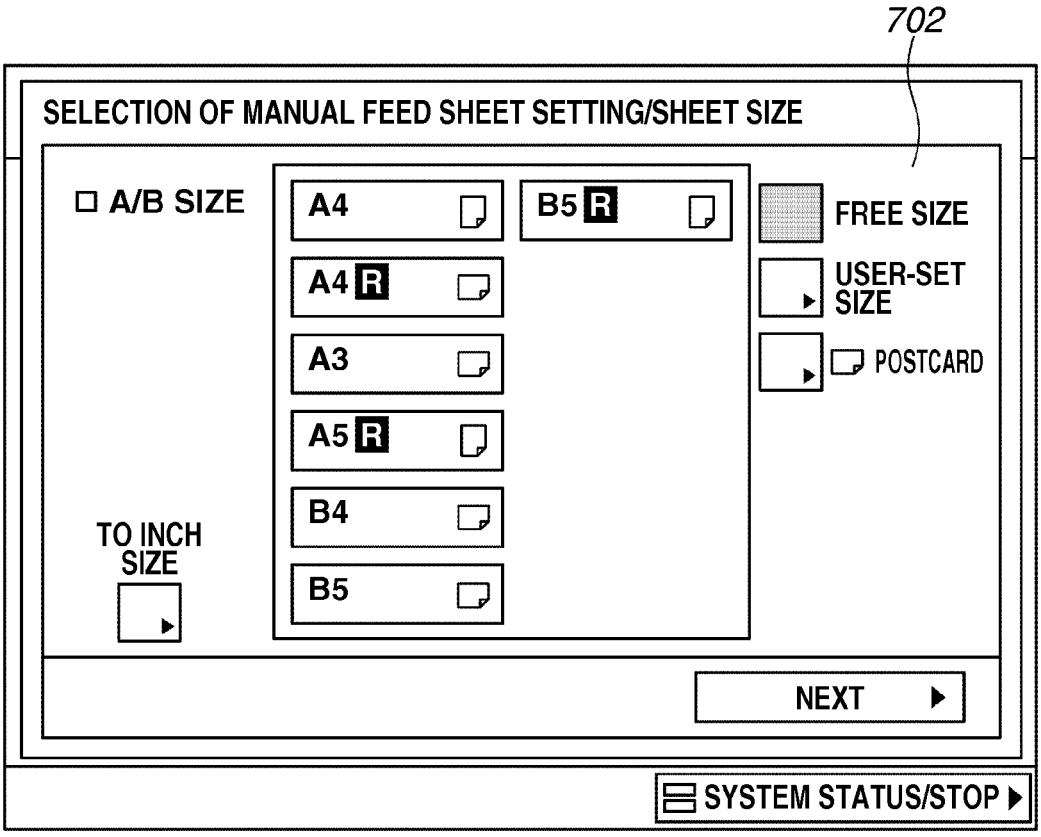
Figure 6C:
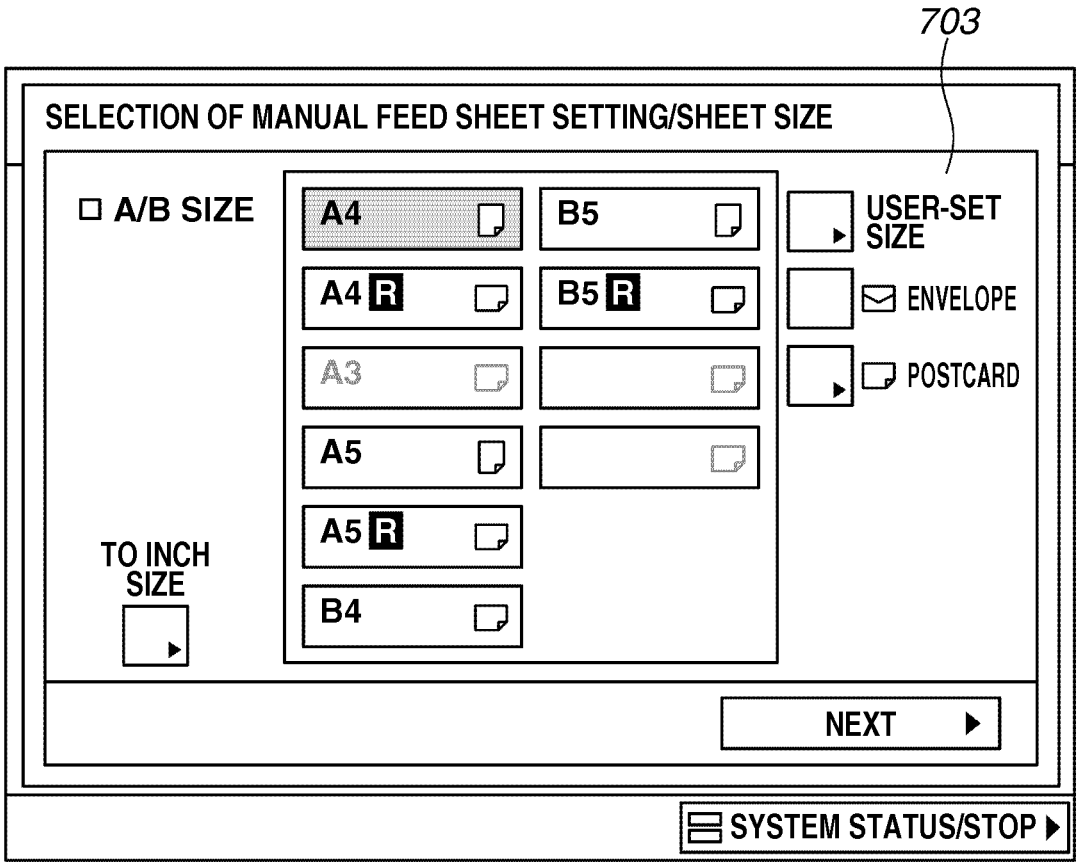
Figure 6D:
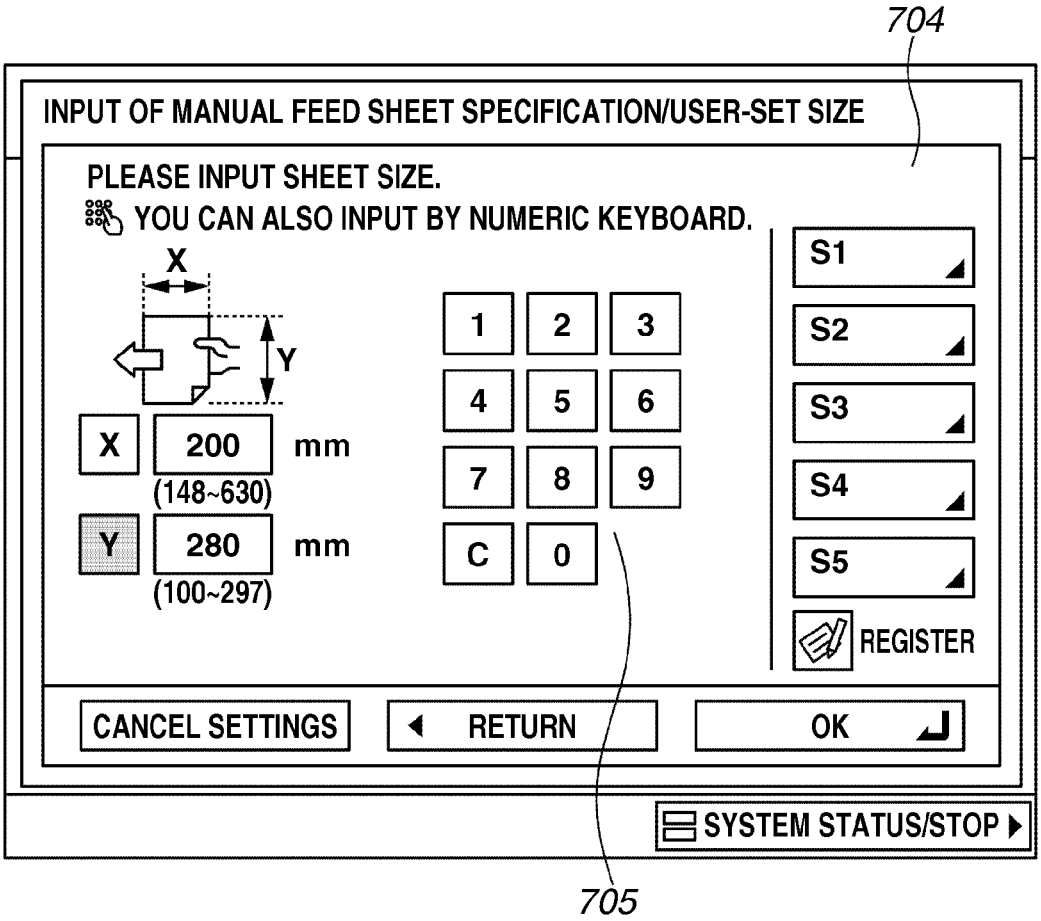
Figure 6E:
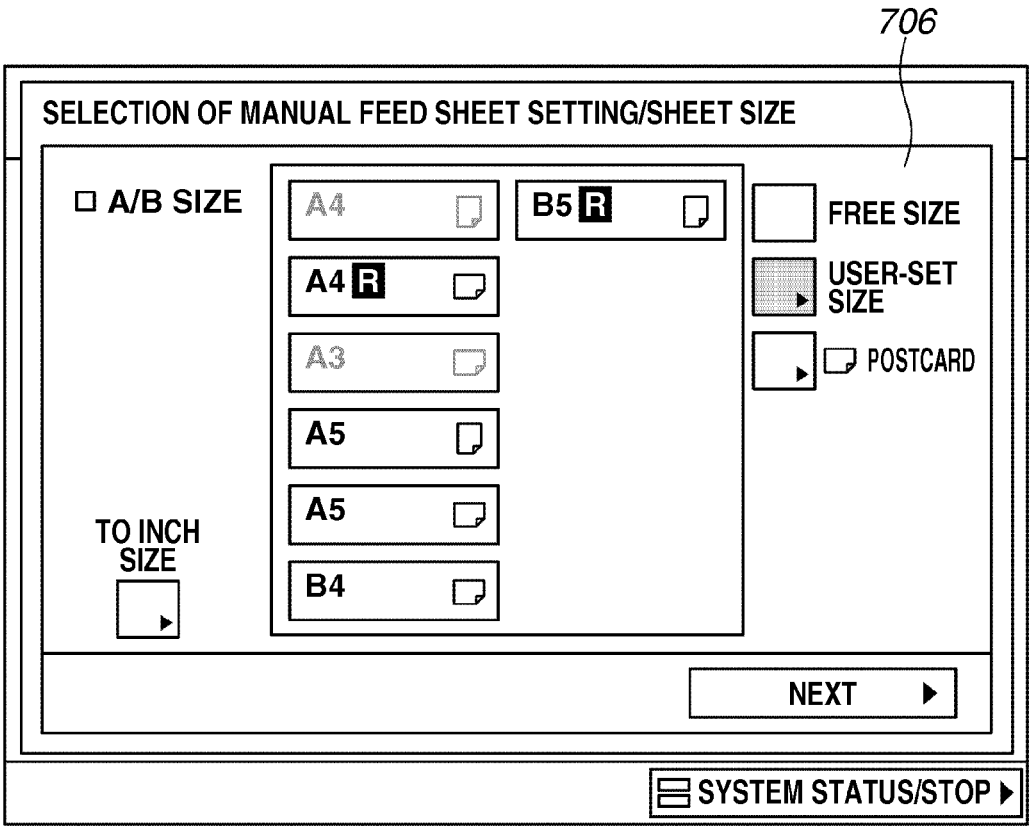
Figure 6F:
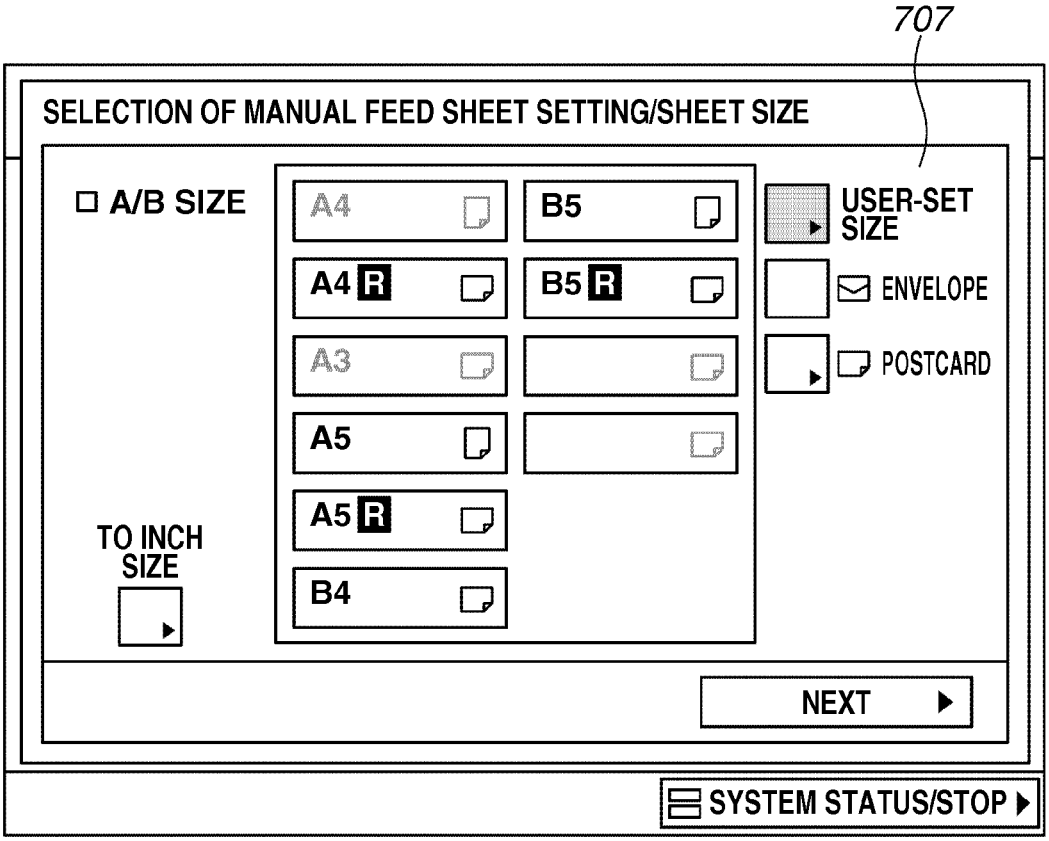
Figure 7A:
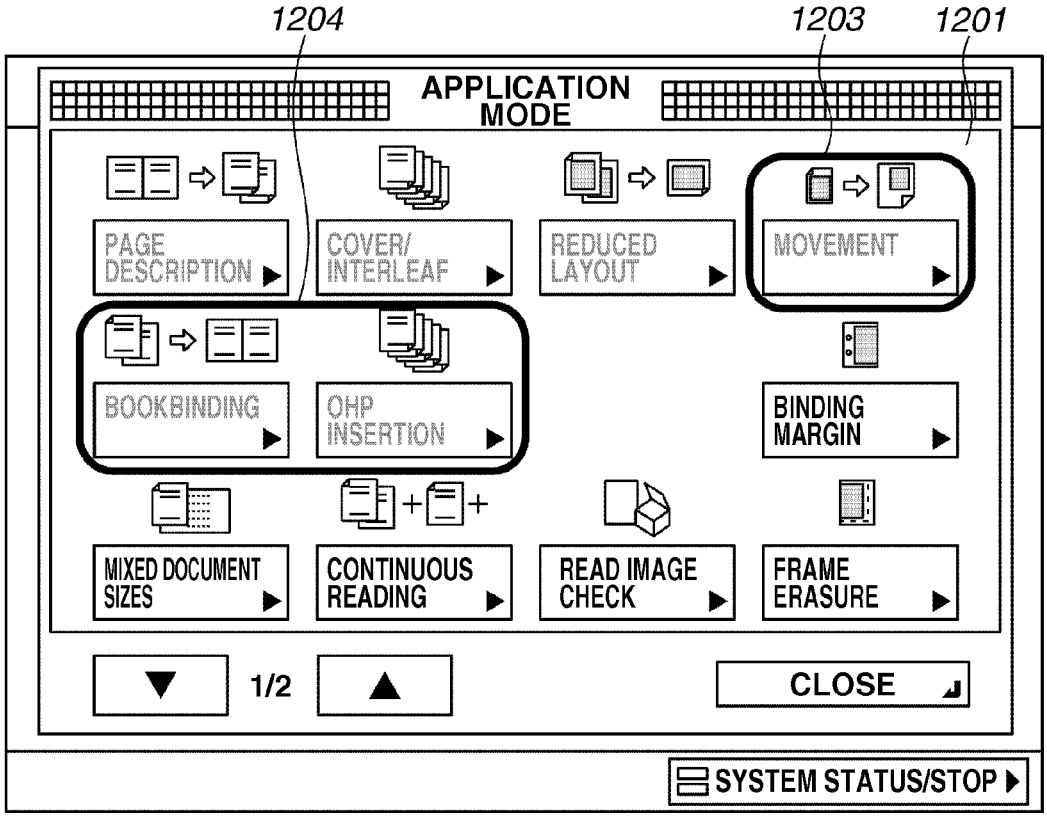
FIGS. 7A to 7D each illustrate a user interface (UI) displayed on the touch panel.
Figure 7B:
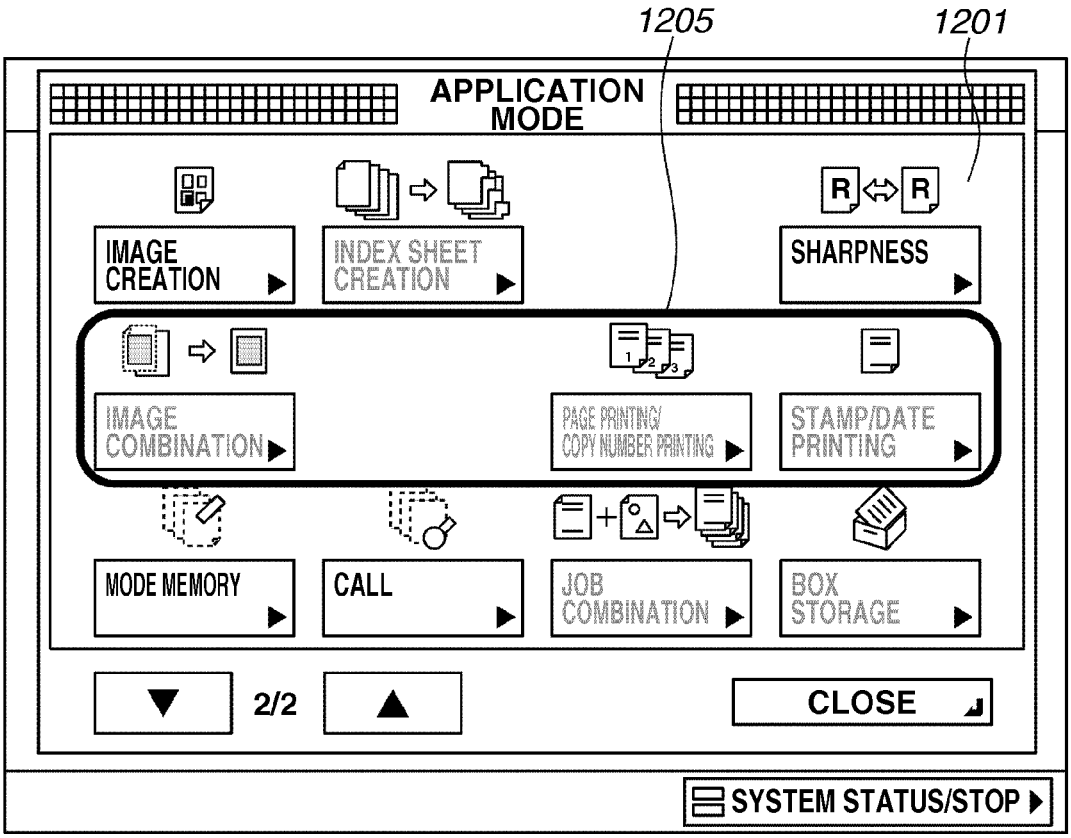
Figure 7C:
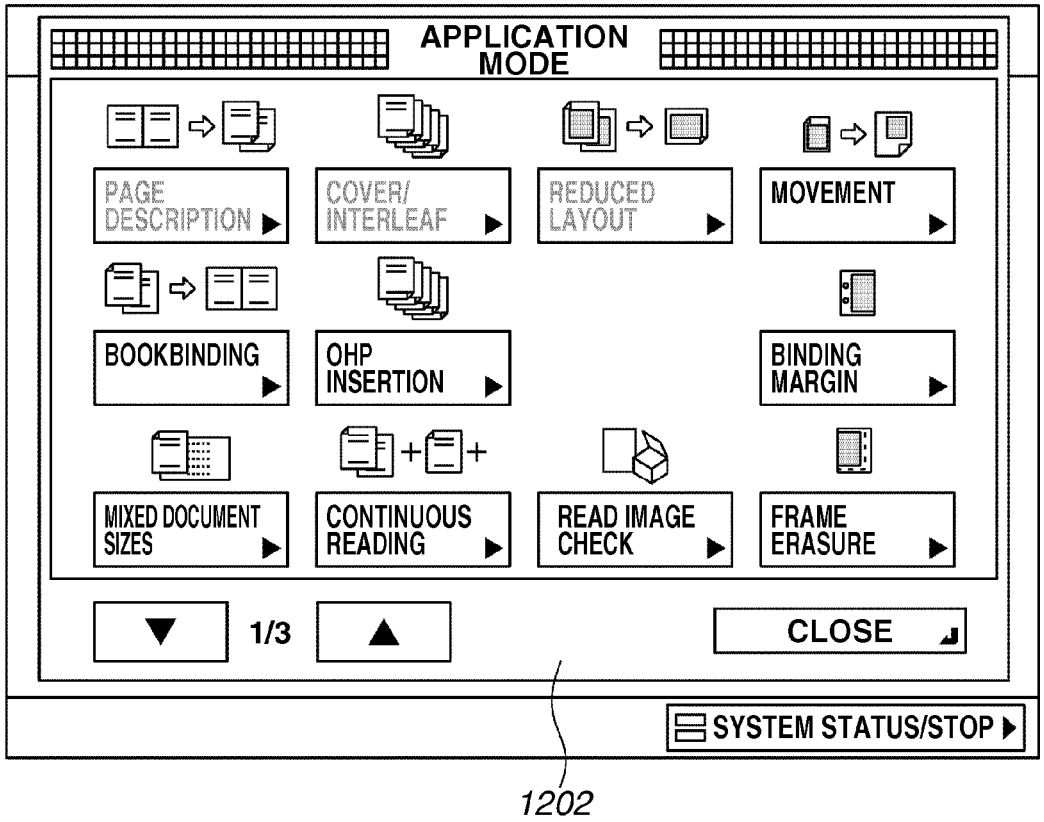
Figure 7D:
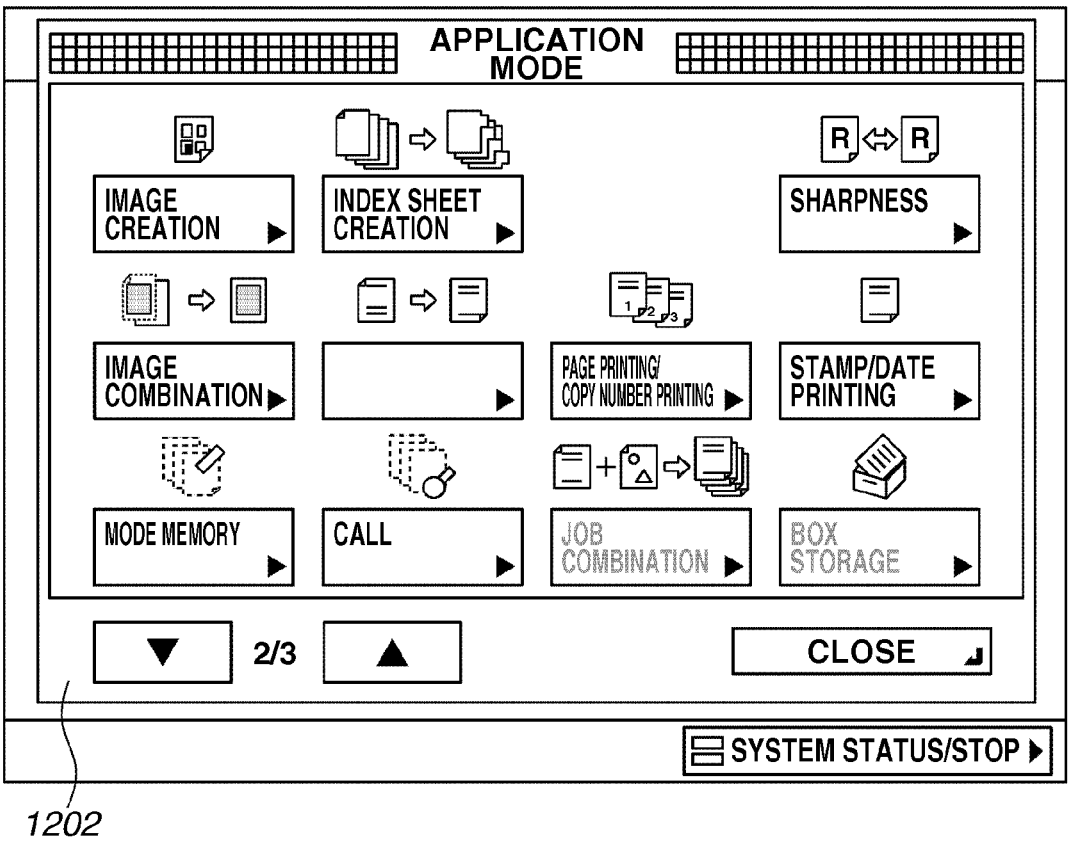

Meanwhile, screens 702 and 703 in FIGS. 6B and 6C are conventional sheet size selection screens on which a user-set size can be specified. The screen 702 is a setting screen in an image forming apparatus in which the setting of both of the free size and the user-set size can be performed. The screen 703 is a setting screen in an image forming apparatus in which only the setting of the user-set size can be performed.

In response to selection of the user-set size, the display screen shifts to the screen 704, and on the screen, an X size and a Y size are input. The user is required to input the X size and the Y size using the buttons on the touch panel 505 or the numerical keypad 504.

The X size and the Y size can be registered to five preset buttons on the right part on the screen 704, and by the buttons, reduction in the complication in the setting operation is achieved. However, at least one input is necessary. After the X size and the Y size are input, by pressing an OK key, the display screen shifts to the screen 706 or the screen 707, and the user-set size is determined.

A screen in the application mode when the user-set size is specified is the screen 1202 illustrated in FIGS. 7A to 7D. On the screen, as compared to the operation screen 1201, the number of functions that cannot be combined is reduced.

In the user-set size, although the setting operation is complicated, the number of the restrictions in the combinations of the application modes is small. Accordingly, more functions can be used as compared to the case of the free size. In the present exemplary embodiment, the apparatus can operate in the user-set size in which the complication in the setting operation is equivalent to that in the free size (regular size), and further the restrictions in the combinations of the application modes are reduced.

Figure 8A:
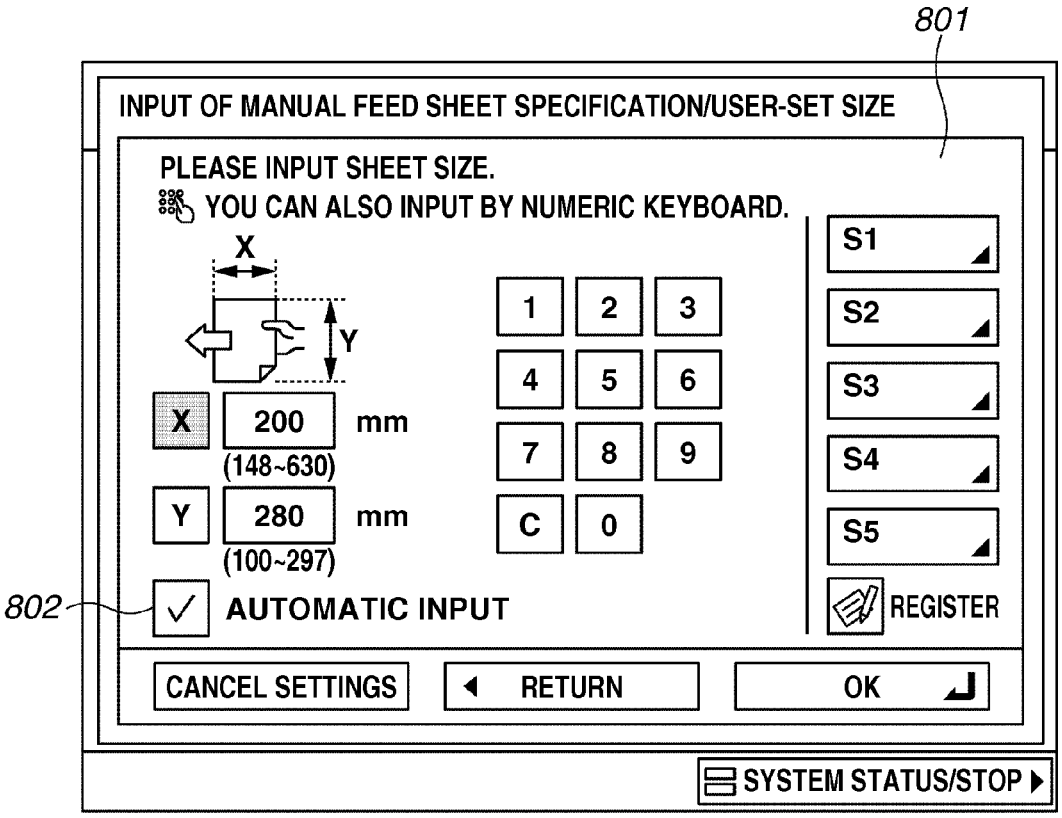
FIGS. 8A to 8F each illustrate a UI of an image forming apparatus according to the exemplary embodiment.

FIGS. 8A to 8F illustrate the user interfaces in the image forming apparatus according to the present exemplary embodiment. In FIG. 8A, a screen 801 is a manual feed sheet setting screen (corresponds to the conventional screen 704). The screen 801 includes an automatic input button 802. The automatic input button 802 is used for the image forming apparatus to perform operation of automatically detecting sheet width detection and sheet length detection by performing sheet conveyance operation.

In the state where the button is turned on, if the user presses the OK button, the display screen shifts to the screen 803. Then, one-sheet conveyance operation for detecting the sheet size by feeding a sheet of paper set on a manual feed tray is performed.

The operation described referring to FIG. 1 or FIG. 2 is performed. While the sheet is being conveyed, a screen such as the screen 803 indicating that the processing for determining the sheet size is being performed is displayed on the touch panel 505.

when the conveyance operation is completed, the display screen shifts to the screen 804. Since the sheet width and the sheet length have been determined, the values are input to the X size and the Y size on the screen 804. Then, if the user presses the OK key, the specification of the user-set size ends.

FIGS. 9A and 9B are flowcharts illustrating control procedures in the image forming apparatus according to the present exemplary embodiment. FIG. 9A corresponds to the sheet size display processing, and FIG. 9B corresponds to detailed steps relating to the sheet conveyance control in step S1006 illustrated in FIG. 9A.

FIG. 9B includes mode setting processing for setting a mode for waiting without performing image formation by the image formation unit for forming an image on a sheet material in a case where the sheet material supplied first is to be discharged. Each step is implemented by the CPU 402 loading a control program read from the ROM 404 on the DRAM 406 and executing the control program.

In step S1002, the CPU 402 monitors whether a sheet is set on the manual feed unit of the image forming apparatus based on a sensor output state. If the CPU 402 detects a sheet being set by the user (YES in step S1002), the processing proceeds to step S1003.

In step S1003, the CPU 402 displays a sheet setting screen on the touch panel 505 (screen 801 in FIG. 8 is displayed). In step S1004, the CPU 402 checks whether the size selected by the use is a regular size or an irregular size. If the CPU 402 determines that the selected size is a regular size (NO in step S1004), the processing proceeds to step S1005. In step S1005, the selected regular size is determined, and the processing ends.

In step S1004, if the CPU 402 determines that an irregular size (user-set size) is selected (YES in step S1004), the processing proceeds to step S1006. In step S1006, the CPU 402 performs sheet conveyance control. The sheet conveyance control is described in detail with reference to steps S1011 to S1014 illustrated in FIG. 9B.

When the control for sheet conveyance is started, since the image formation is not performed, in step S1011, a special mode for conveying the sheet while the fixing device remains in a standby temperature adjustment state, is set. In a case of the fixing device in which not only heating but also pressing in the fixing device can be turned on or off, further using a separation mechanism, the fixing device can be controlled to be in a separated state. By performing such a control, an excess amount of heat can be reduced.

In step S1012, in response to the start of the sheet conveyance, the CPU 402 detects a guide width, and determines the sheet width. In step S1013, the CPU 402 determines the sheet length based on the detection of a leading edge and a trailing edge of the sheet by the detection sensor 102 arranged in the conveyance path and according to information of a conveyance speed. Specifically, for example, the CPU 402 determines the product of the time period from the detection of the leading edge to the detection of the trailing edge, and the conveyance speed of the sheet to be the sheet length.

Figure 8B:
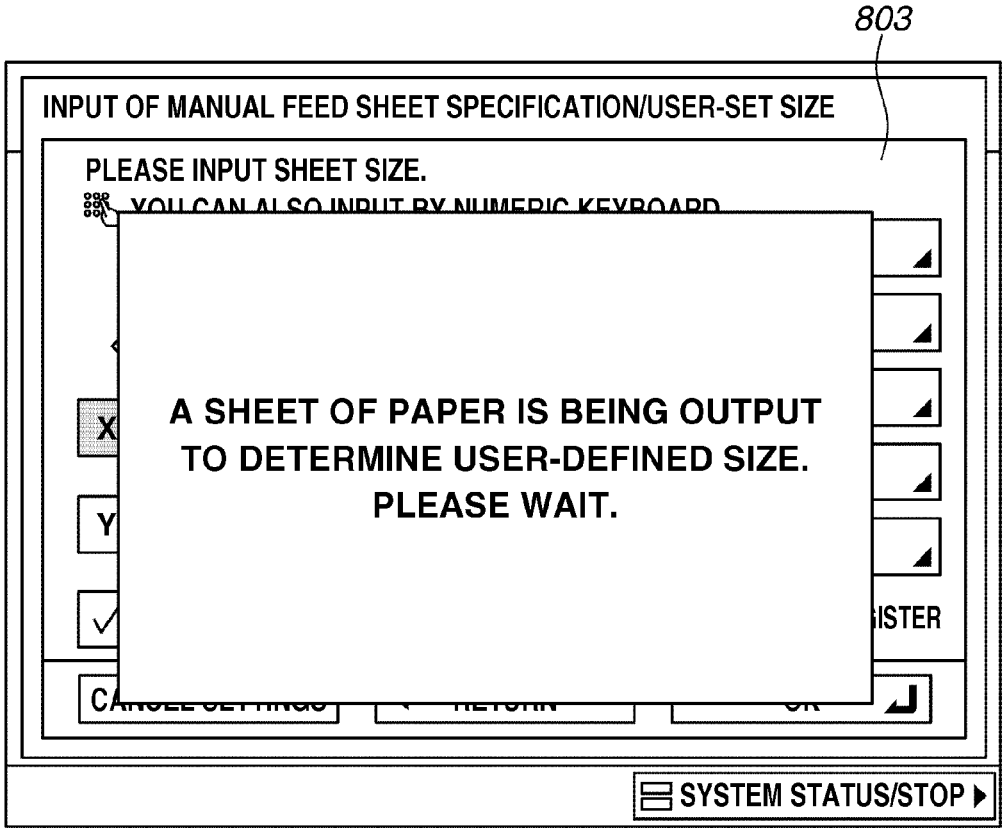
Figure 8C:
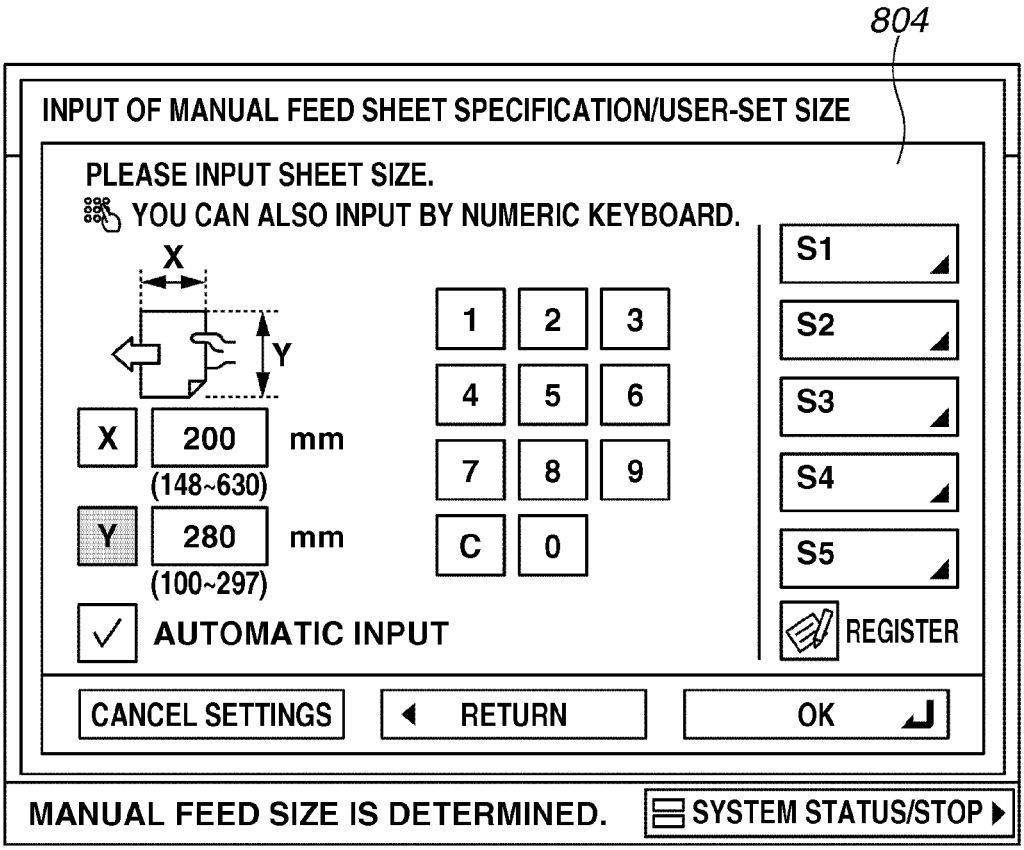
Figure 8D:
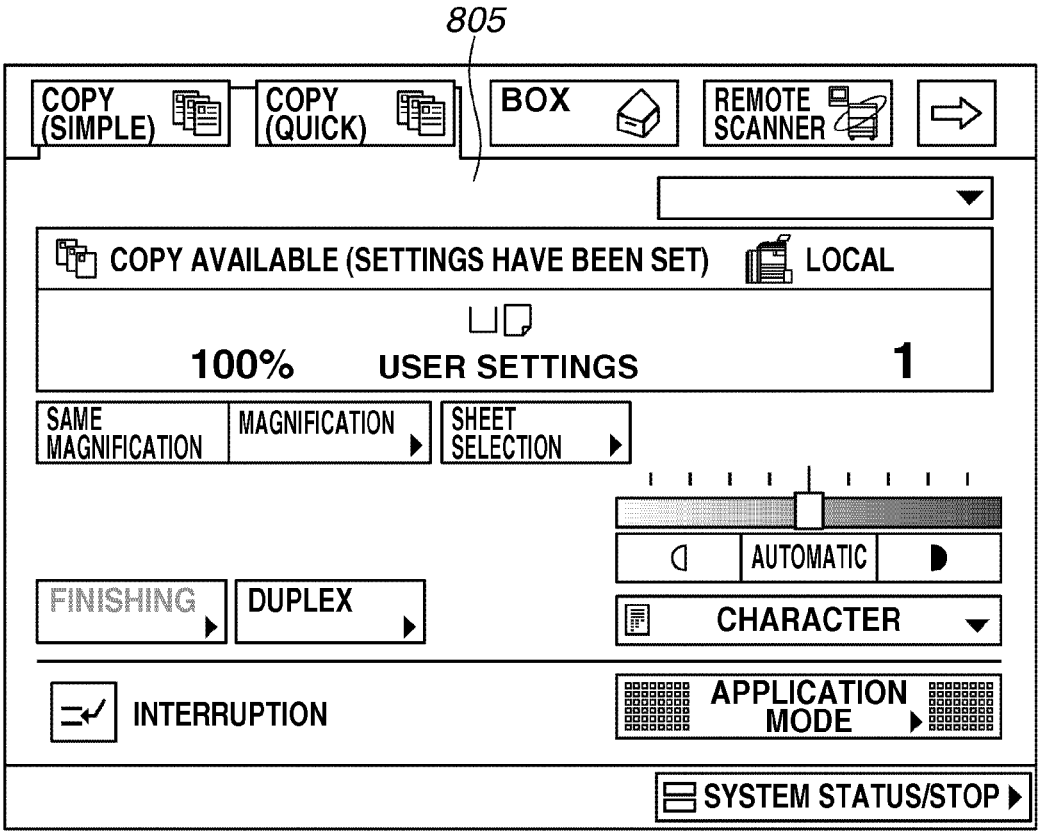
Figure 8E:
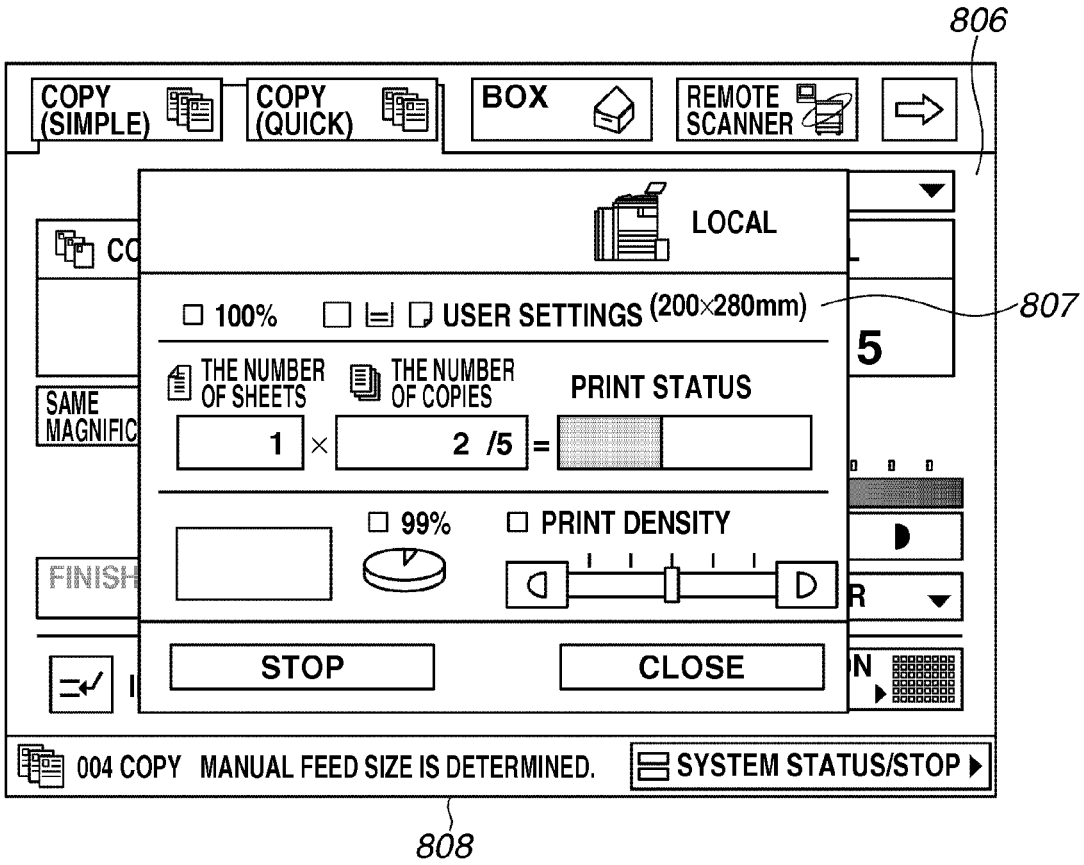
Figure 8F:
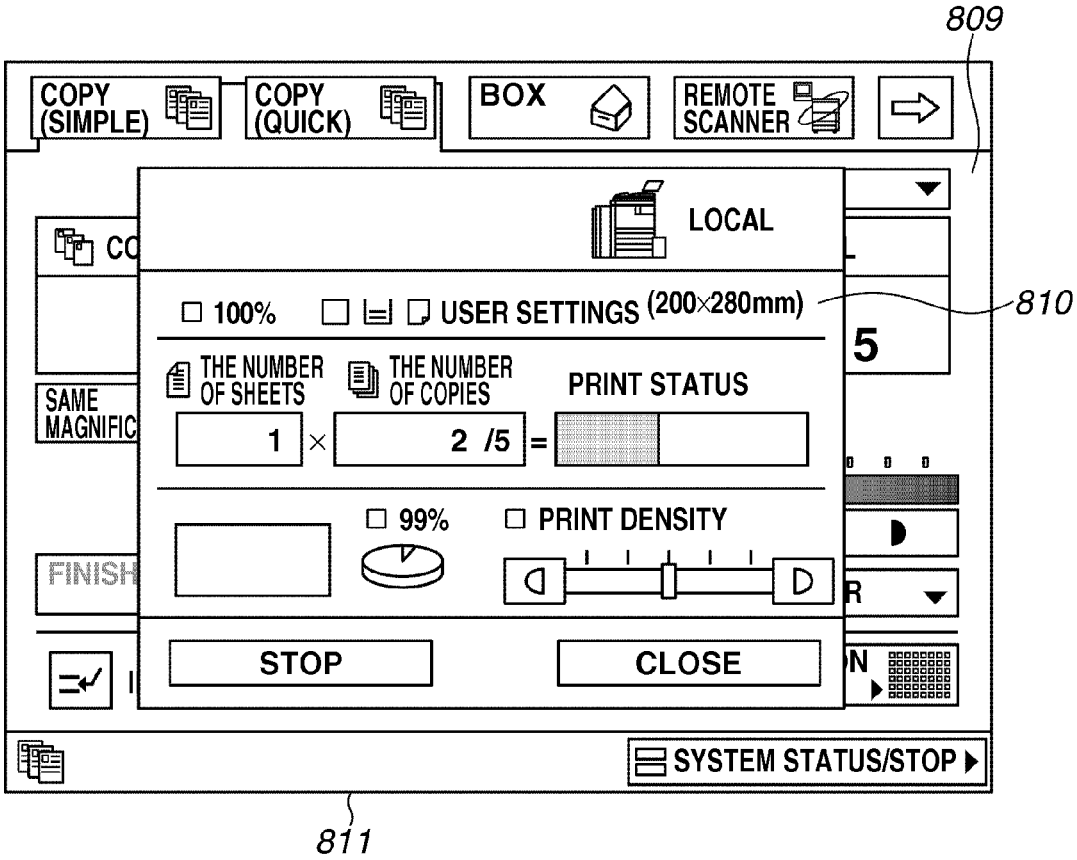

While the processing is being performed, the screen 803 in FIG. 8B is displayed on the touch panel 505. In step S1014, the CPU 402 performs control of the conveyance drive system to discharge the sheet to be used for the sheet size detection to the outside of the apparatus.

If the apparatus has a plurality of output destinations, the sheet is output to a tray, which is different from that specified in the normal printing, such as a sample tray or an escape tray. Then, the processing ends. The processing is to prevent a normal output and the sheet for the size detection from being mixed with each other.

Returning to step S1007, the CPU 402 stores the state of the determined sheet width and sheet length. In step S1008, the CPU 402 displays the determined size information on the touch panel 505. Then, the processing ends.

The sheet size determined in step S1007 is stored in the DRAM 406 until the sheets on the manual tray run out next. By the processing, if image formation with a sheet size (for example, free size) whose sheet width and sheet length are unknown is requested, the CPU 402 can perform control in such a manner that the apparatus operates with the determined sheet size.

By performing the above-described control, the image forming apparatus capable of reducing the complication in the user's setting operation and allowing the use of sheets of irregular sizes more easily, can be provided.

Differences of the second exemplary embodiment in the configuration from that in the first exemplary embodiment are described below. In the first exemplary embodiment, the one-sheet conveyance operation is always performed using a sheet for the detection in order to determine a sheet size. In the present exemplary embodiment, a sheet for the sheet size detection is also used as a sheet for the normal printing depending on conditions.

A part of the present exemplary embodiment has been described in the descriptions of FIGS. 1A, 1B, and 2 in the first exemplary embodiment. In a sheet size where a trailing edge of a sheet can completely pass through a sheet trailing edge detection sensor but a leading edge of the sheet does not arrive at a secondary transfer position (the position 320 in FIG. 1A, and the position 212 in FIG. 2), a sheet for the sheet size detection is also used as a sheet for the normal printing. By the processing, control for eliminating a special sheet for the size detection can be performed.

The description will be made with reference to FIGS. 8A to 8F. In the state of the screen 801, automatic input is turned on. Then, in response to pressing the OK key by the user, the display screen shifts to the screen 805. The screen 805 is a normal copy screen. By starting copying, the normal printing operation starts. Although not illustrated in FIGS. 8A to 8F, on a box screen or in PDL print, the processing is similarly performed.

In a state a manual feed stage of a user-set size is being specified, if the normal printing starts, the screen display shifts to the screen 806 or the screen 809, and a dialogue screen "during the printing" is displayed.

Then, a first sheet in the normal printing is supplied from the manual feed tray, and the sheet size detection control described referring to FIG. 1 or FIG. 2 is performed.

If the CPU 402 determines that the sheet for the sheet size detection can also be used as the sheet for the normal printing, as illustrated in the screen 807, a detailed size of the user setting is displayed on the dialogue screen in printing. At the same time, the CPU 402 displays a message indicating that the manual feed size is determined in a status line on the touch pane 505 as illustrated in the screen 808.

If the CPU 402 determines that the sheet for the normal printing cannot be used for the sheet size detection, the sheet that is fed first is switched to a sheet specialized in the sheet size detection, and the CPU 402 performs the size detection control. Then, the CPU 402 displays the determined detailed user-set size as illustrated in the screen 810 in the dialogue screen in the printing.

On the other hand, in the display in the status line, the CPU 402 displays a message that indicates not only the determination of the sheet of the manual feed size has been made but also the output of one special sheet for the detection has done.

Figure 10A:
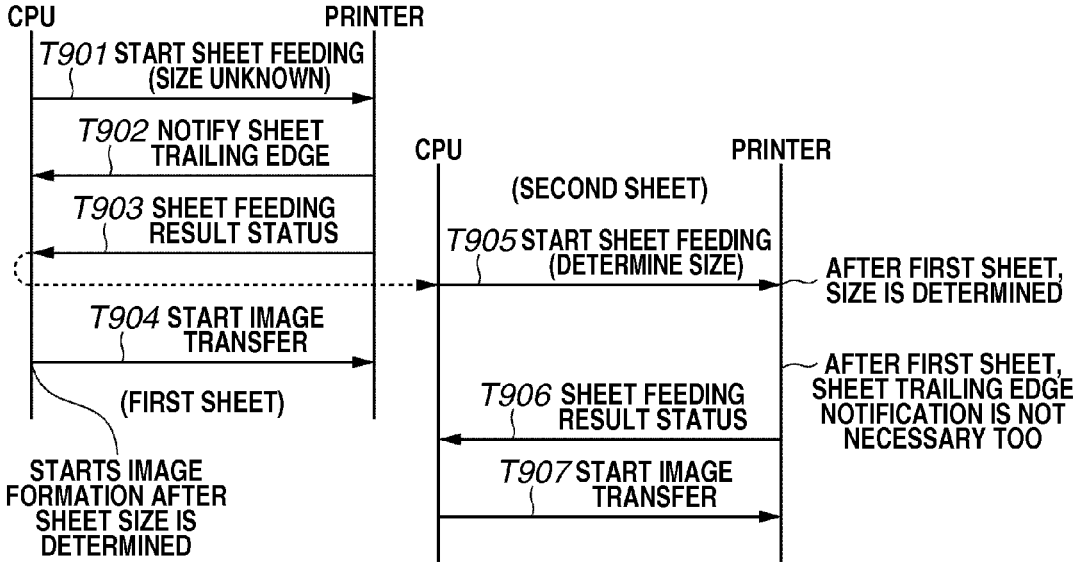
FIGS. 10A and 10B are timing charts illustrating control examples of the image forming apparatus.
Figure 10B:
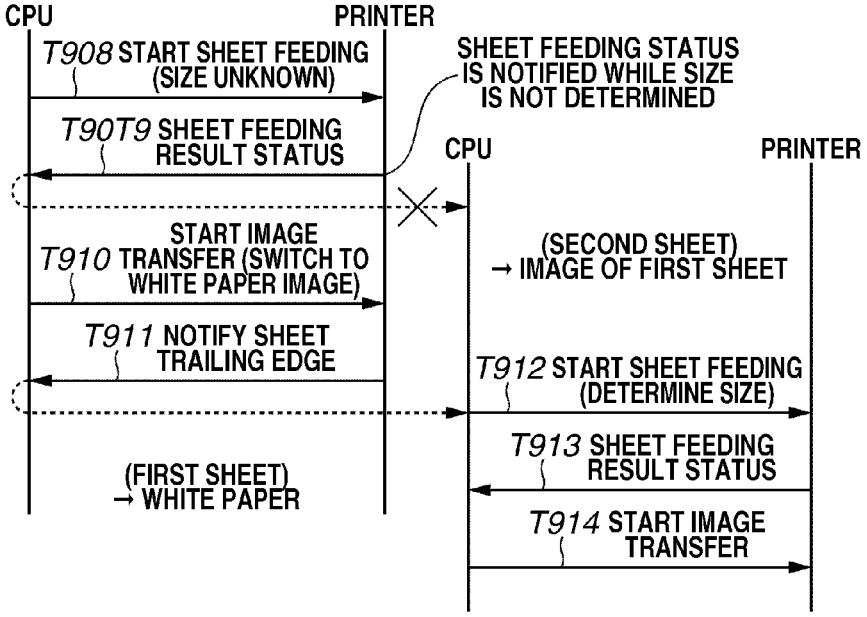

Next, with reference to FIGS. 10A and 10B, control sequences in a case where the sheet for the sheet size detection can also be used as the sheet for the normal printing, and in a case where the sheet cannot be used in common are described. FIGS. 10A and 10B are timing charts illustrating control examples in the image forming apparatus according to the present exemplary embodiment. The examples are sequence examples performed between the main controller 401 illustrated in FIG. 4 and the printer unit connected to the tip of the printer I/F 430.

FIG. 10A illustrates an example of a sequence in a case where trailing edge detection can be performed in a state a sheet standby position can be ensured before printing. In the example, according to the timing from detection of the leading edge of the sheet material to detection of the trailing edge, a formed image can be normally formed on the sheet material. In FIGS. 10A and 10B, T901 to T914 indicate each step timing.

First, at T901, sheet feeding start is notified from the CPU 402 in the main controller 401 to the printer. Since the sheet size information is not determined, the sheet feeding start instruction is performed in the state where the size is unknown. When the sheet is conveyed and passes through the detection sensor 102, at T902, a sheet trailing edge notification is transmitted from the printer to the CPU 402 in the main controller 401.

Then, at T903, after the sheet passes through the detection sensor 102, and a predetermined time period has elapsed, a sheet feeding result status is notified. The predetermined time period is, for example, a time period to be elapsed until image formation onto the intermediate transfer belt becomes possible to be performed according to the image data transmitted from the main controller 401 to the printer.

After the sheet feeding result status is received, the CPU 402 issues an image transfer start instruction to the printer. At T903, before the sheet feeding result status is notified, if the CPU 402 determines that a sheet trailing edge notification is issued at T902, the processing proceeds to T904. In order to start the image transfer at T904, if the sheet size is determined at this point, the sheet for the sheet size detection can be switched to the sheet for the normal printing operation.

However, since only in the case of the first sheet in the normal printing, the image formation is started in the state where the sheet is in the standby state at the position 104, the standby time at the point 104 is longer than that in cases of a second sheet and the subsequent sheets.

In the case of the second sheet and the subsequent sheets, at the point the sheet feeding start notification is performed at T905, the sheet size is determined. Accordingly, the notification can be issued in the state the size is determined, and it is not necessary to wait the sheet in the standby state at the position 104.

In the case of the second and the subsequent sheets, the trailing edge detection notification is not necessary either. Accordingly, the notification from the printer to the CPU 402 is not also performed. At T906, the sheet feeding result status is notified. At T907, an image transfer start notification is issued. If the third page and the subsequent pages exist, a sequence similar to that of the second sheet is performed.

FIG. 10B illustrates an example of a sequence in a case where the trailing edge detection cannot be performed in the state the sheet standby position can be ensured before the printing. In the example, according to the timing from the detection of the leading edge of the sheet material to the detection of the trailing edge, an image cannot be normally formed on the sheet material. Accordingly, in this case, the CPU 402 performs control so that a sheet that is conveyed first and used to determine the sheet size is discharged to a discharge destination. The sheet remains to be a blank sheet without performing the image formation by the image forming unit.

First, at T908, sheet feeding start is notified from the CPU 402 to the printer. Since the sheet size information is not determined, the sheet supply start instruction is performed in the state the size is unknown. Before the sheet is conveyed and the trailing edge passes through the detection sensor 102, the sheet arrives at the position 104. Accordingly, the printer cannot notify the CPU 402 that the printer has detected the trailing edge of the sheet.

In such a case, at T909, the printer notifies the sheet feeding result status to the CPU 402. The CPU 402 that has received the sheet feeding result can detect that the sheet trailing edge detection has not completed yet (the trailing edge detection notification has not been received). Then, at T910, the image transfer start instruction to the printer is performed by switching thereof to a white paper image.

At this point, the control is switched to the control of the special sheet for the sheet size detection. In response to the instruction of the image transfer start, the printer resumes the sheet conveyance from the position 104. Then, after a period of time, the trailing edge of the sheet is detected. At T911, a sheet trailing edge notification is notified to the main controller.

A first sheet is output as a blank sheet. Since the size has been determined by the information of the sheet trailing edge notification at T911, sheet feeding start of a second sheet can be instructed from the main controller to the printer in the size-determined state.

The following steps are performed according to the normal printing sequence, that is, a sheet feeding result status 913 from the printer to the main controller, and an image transfer start 914 from the main controller to the printer. If the third page and the subsequent pages exist, a sequence similar to that in the second sheet is performed.

Figure 11:
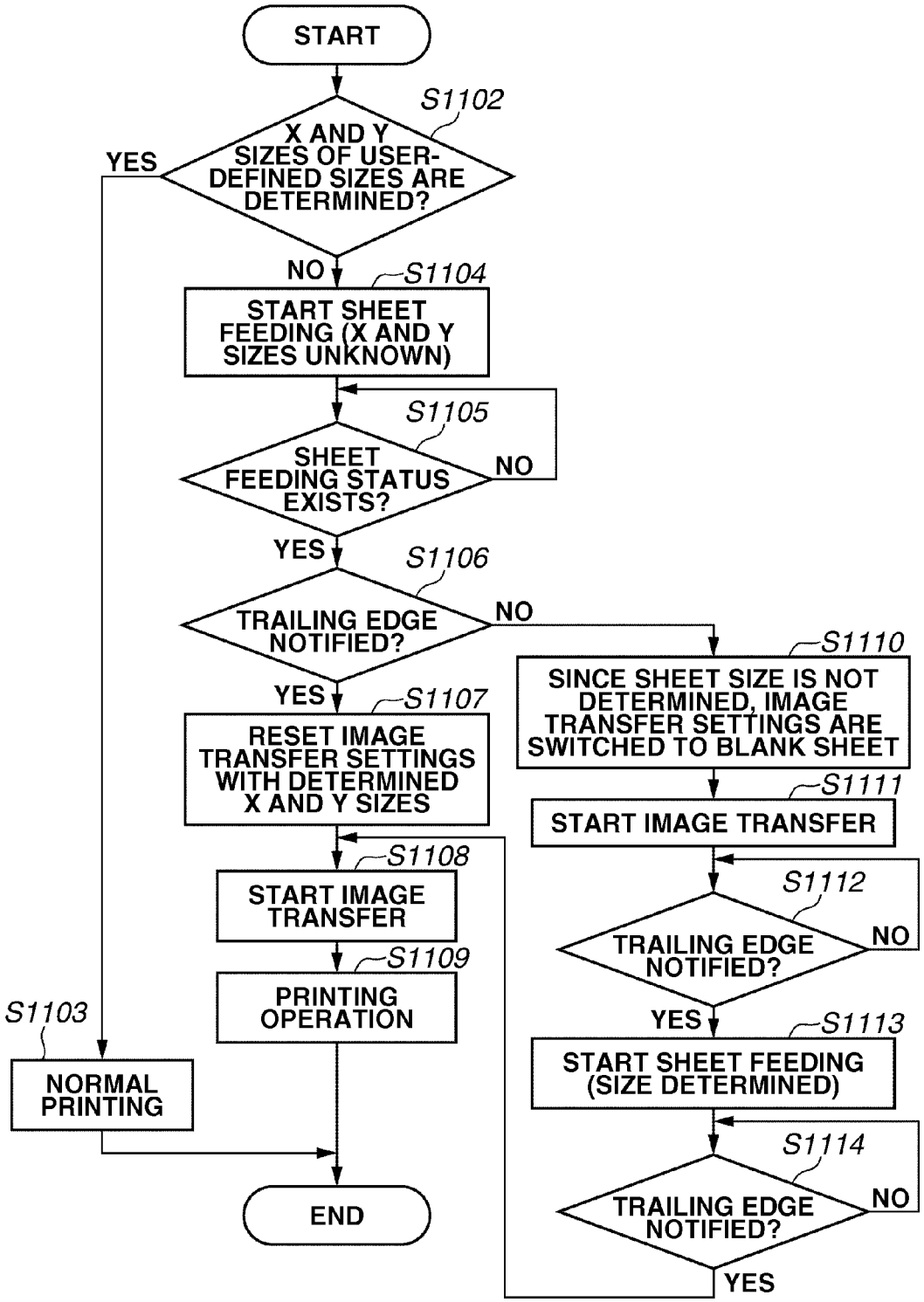
FIG. 11 is a flowchart illustrating a control procedure of the image forming apparatus.

FIG. 11 is a flowchart illustrating a control procedure of an image forming apparatus according to the present exemplary embodiment. Each step is implemented by the CPU 402 loading a control program read from the ROM 404 or the like on the DRAM 406 and executing thereof.

Steps S1102 to S1109 are performed in a case where a sheet for the sheet size detection can also be used as a sheet for the normal printing. Steps S1100 to S1114 are performed in a case where a sheet for the sheet size detection cannot be used as a sheet for the normal printing.

First, in step S1102, the CPU 402 checks whether the X size and the Y size in the user-set sizes are determined. In a case where the CPU 402 determines that the X size and the Y size are determined (YES in step S1102), the processing proceeds to step S1103, and the normal printing operation is performed. The most of the cases where once the size is determined and until the sheets run out next correspond to the above-described case.

In step S1102, if the CPU 402 determines that the X size and the Y size are not determined (NO in step S1102), the processing proceeds to step S1104. In step S1104, sheet feeding starts while the sizes are unknown (the X size and the Y size are unknown).

In step S1105, the loop operation is performed until a sheet feeding status is notified. When the sheet feeding status is notified (YES in step S1105), in step S1106, the CPU 402 checks whether a sheet trailing edge notification has already been notified. If the CPU 402 determines that the notification has been notified (YES in step S1106), the processing proceeds to step S1107.

In step S1107, after image transfer settings are reset with the determined X size and the Y size, in step S1108, the CPU 402 instructs the printer to start image transfer. Then, after printing operation is performed in step S1109, the processing ends.

As described above, without outputting a special sheet for the sheet size detection, the printing operation can be performed. Then, in step S1106, if the CPU 402 determines that the trailing edge notification is not notified in spite of the fact that the sheet feeding status has been notified (No in step S1106), the processing proceeds to step S1110.

In step S1110, since the sheet size is not determined, the image transfer setting is switched to the blank sheet. In step S1111, the CPU 402 instructs the printer to start the image transfer. According to the instruction, the first sheet is switched to a special sheet for the sheet size detection. If the sheet conveyance is resumed, in step S1112, the trailing edge notification is monitored, and the trailing edge notification is notified from the printer to the CPU 402.

In step S1113, the CPU 402 instructs the printer to start sheet feeding for the normal printing in the size-determined state. In step S1114, the sheet feeding status of the sheet for the normal printing is monitored, and if the CPU 402 determines that the sheet feeding status is notified (YES in step S1114), the processing returns to step S1108, and the CPU 402 instructs the printer to start the image transfer. In step S1109, the printing operation is performed, and the processing ends.

By performing the control in this way, a special sheet for the sheet size detection is not always to be used as described in the first exemplary embodiment. Accordingly, depending on the configuration (the length of the conveyance path of the apparatus) of the image forming apparatus and the sheet size, without outputting an extra sheet, the detection of an irregular size can be performed without the complication in the user's setting operation.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium). In such a case, the system or apparatus, and the recording medium where the program is stored, are included as being within the scope of the present invention. In an example, a computer-readable medium may store a program that causes an image forming apparatus to perform a method described herein. In another example, a central processing unit (CPU) may be configured to control at least one unit utilized in a method or apparatus described herein.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-187832 filed Aug. 25, 2010, which is hereby incorporated by reference herein in its entirety.

What is claimed is:

1. An image forming apparatus for forming an image formation on a sheet, the image forming apparatus comprising:

a determining unit configured to determine a length in a conveyance direction of a first sheet fed from a sheet holding unit; and control unit configured to control to discharge the first sheet fed from the sheet holding unit to a discharge destination without forming an image on the first sheet and to control to form an image on a second sheet following the first sheet according to the length determined by the determining unit and then discharge the second sheet, the first sheet and the second sheet being discharged by performing a same job.

2. The image forming apparatus according to claim 1, wherein the control unit determines whether to form an image on the first sheet according to a timing of determining the length of the first sheet by the determining unit and a timing of forming, by a printing unit, rasterized image data.

3. The image forming apparatus according to claim 2, wherein, in response to the timing of determining the length of the first sheet being earlier than the timing of forming, by the printing unit, the rasterized image data, the control unit controls to form the image on the first sheet, and, in response to the timing of determining the length of the first sheet being later than the timing of forming, by the printing unit, the rasterized image data, the control unit discharges the sheet to the discharge destination without forming the image on the first sheet.

4. The image forming apparatus according to claim 1, wherein the determining unit determines the length in the conveyance direction of the first sheet fed from a sheet holding unit based on timings at which a leading edge is detected and at which a trailing edge of the first sheet is detected.

5. A control method for controlling an image forming apparatus for forming an image on a sheet, the control method comprising:

determining a length in a conveyance direction of a first fed sheet; and controlling to discharge the fed first sheet to a discharge destination without forming an image on the first sheet and controlling to form an image on a second sheet following the first sheet according to the determined length and then discharging the second sheet, the first sheet and the second sheet being discharged by performing a same job.

6. A non-transitory computer readable storage medium storing a computer program to cause an image forming apparatus to perform a control method for forming an image on a sheet, the control method comprising:

determining a length in a conveyance direction of a fed first sheet; and controlling to discharge the fed first sheet to a discharge destination without forming an image on the first sheet and controlling to form an image on a second sheet following the first sheet according to the determined length and then discharging the second sheet, the first sheet and the second sheet being discharged by performing a same job.

* * * * *